US008437656B2

(12) United States Patent
Itabashi

(10) Patent No.: US 8,437,656 B2
(45) Date of Patent: May 7, 2013

(54) CHARGER

(75) Inventor: Nao Itabashi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 437 days.

(21) Appl. No.: 12/750,760

(22) Filed: Mar. 31, 2010

(65) Prior Publication Data

US 2010/0296835 A1 Nov. 25, 2010

(30) Foreign Application Priority Data

May 19, 2009 (JP) ..... 2009-120618
Sep. 14, 2009 (JP) ..... 2009-212295
Sep. 14, 2009 (JP) ..... 2009-212299

(51) Int. Cl.
*G03G 15/02* (2006.01)

(52) U.S. Cl.
USPC ..... 399/100

(58) Field of Classification Search ..... 399/99, 399/100, 115, 170, 171, 350, 351
See application file for complete search history.

(56) References Cited

U.S. PATENT DOCUMENTS 4,019,055 A * 4/1977 Derleth ..... 399/100
4,908,513 A * 3/1990 Masuda et al. ..... 399/100
5,117,264 A * 5/1992 Frankel et al. ..... 399/350
5,485,251 A * 1/1996 Kita et al. ..... 399/343
5,687,054 A 11/1997 Takada et al.
7,809,306 B2 * 10/2010 Itabashi ..... 399/100
2004/0136763 A1 * 7/2004 Murakami et al. ..... 399/350
2004/0240915 A1 * 12/2004 Nakayama ..... 399/345
2008/0260417 A1 * 10/2008 Hotani ..... 399/100

FOREIGN PATENT DOCUMENTS

JP 60-54145 4/1985
JP 03-35555 A 4/1991
JP 03-065157 6/1991
JP 03-065158 6/1991
JP 04-050971 2/1992
JP 04-097802 3/1992
JP 04-204874 7/1992

(Continued)

OTHER PUBLICATIONS

JP Office Action dated Jul. 12, 2011, corresponding Application No. 2009-212299; English Translation.

(Continued)

*Primary Examiner* — David Gray
*Assistant Examiner* — Thomas Giampaolo, II
(74) *Attorney, Agent, or Firm* — Banner & Witcoff, Ltd.

(57) ABSTRACT

A charger includes: a discharge wire extending in a predetermined extension direction; an opposite electrode extending in the extension direction and facing to the discharge wire; a frame configured to support the discharge wire and the opposite electrode; and a cleaning member configured to move in the extension direction while slidably contacting with the opposite electrode so as to clean the opposite electrode. The cleaning member includes: a sheet-like member contacting with the opposite electrode; and a support member configured to support the sheet-like member. The sheet-like member has a distal end contacting with the opposite electrode, and a proximal end at an opposite end of the distal end. The support member supports the sheet-like member obliquely relative to the opposite electrode such that the distal end and the proximal end of the sheet-like member are arranged in different positions with respect to the extension direction.

30 Claims, 24 Drawing Sheets

FOREIGN PATENT DOCUMENTS

| | | | |
|---|---|---|---|
| JP | 04-369663 | | 12/1992 |
| JP | 05-297688 | | 11/1993 |
| JP | 06-25849 | U | 4/1994 |
| JP | 07-301978 | | 11/1995 |
| JP | 09-134062 | A | 5/1997 |
| JP | 09-244357 | | 9/1997 |
| JP | 11-249391 | | 9/1999 |
| JP | 2001-013765 | A | 1/2001 |
| JP | 2001-117326 | | 4/2001 |
| JP | 2001-142284 | | 5/2001 |
| JP | 2001-159840 | | 6/2001 |
| JP | 2002-067420 | | 3/2002 |
| JP | 2004-109721 | | 4/2004 |
| JP | 2006-301384 | A | 11/2006 |

OTHER PUBLICATIONS

JP Office Action dated Jul. 12, 2011, corresponding Application No. 2009-212295; English Translation.

JP Office Action dtd Apr. 19, 2011, JP Appln. 2009-120618, English translation.

* cited by examiner

CHARGER

CROSS-REFERENCE TO RELATED APPLICATION(S)

This application claims priority from Japanese Patent Application No. 2009-120618 filed on May 19, 2009 and Japanese Patent Application Nos. 2009-212295 and 2009-212299 both filed on Sep. 14, 2009, the disclosures of which are incorporated herein by reference in its entirety.

BACKGROUND OF THE INVENTION

1. Field of the Invention

The present invention relates to a charger provided with a cleaning member for cleaning a discharge wire and an opposite electrode.

2. Description of Related Art

A conventional charger known in the art includes a discharge wire extending in an axial direction of a photoconductor drum, a grid electrode (opposite electrode) disposed between the discharge wire and the photoconductor drum, and a cleaning member slidably contacting with the discharge wire and the grid electrode to clean them.

Usually, in this conventional technique, a sponge-like member is used in the cleaning member at an area contacting with the grid electrode. However, such a sponge-like member has a difficulty in sufficiently removing foreign objects, such as toner, adhering to the grid electrode.

In light of the above disadvantage, the present invention seeks to provide a charger which can favorably remove foreign objects adhering to the opposite electrode (e.g., grid electrode) facing to the discharge wire.

SUMMARY OF THE INVENTION

According to a first aspect of the present invention, a charger comprises: a discharge wire extending in a predetermined extension direction; an opposite electrode extending in the extension direction along which the discharge wire extends and facing to the discharge wire; a frame configured to support the discharge wire and the opposite electrode; and a cleaning member configured to move in the extension direction while slidably contacting with the opposite electrode so as to clean the opposite electrode; wherein the cleaning member comprises: a sheet-like member contacting with the opposite electrode; and a support member configured to support the sheet-like member, wherein the sheet-like member includes a distal end at which the sheet-like member contacts with the opposite electrode, and a proximal end at an opposite end of the distal end, and wherein the support member supports the sheet-like member obliquely relative to the opposite electrode such that the distal end and the proximal end of the sheet-like member are arranged in different positions with respect to the extension direction.

As used herein, the term "to support the sheet-like member obliquely" indicates that the sheet-like member is supported in a slanted posture (i.e., neither parallel with nor perpendicular to) relative to the opposite electrode.

According to a second aspect of the present invention, a charger comprises: a discharge wire extending in a predetermined extension direction; a grid electrode extending in the extension direction along which the discharge wire extends and facing to the discharge wire; a frame configured to support the discharge wire and the grid electrode; and a cleaning member configured to move in the extension direction while slidably contacting with the grid electrode so as to clean the grid electrode, wherein the cleaning member comprises a film-like contact member configured to be supported in a folded state, and the contact member contacts with the grid electrode at a folded portion of the contact member.

As used herein, the term "in a folded state" indicates that the film-like contact member is folded such that the section thereof forms a perfect circle, an ellipse, or other shapes.

According to a third aspect of the present invention, a charger comprises: a discharge wire extending in a predetermined extension direction; an opposite electrode extending in the extension direction along which the discharge wire extends and facing to the discharge wire; a frame configured to support the discharge wire and the opposite electrode; and a cleaning member configured to move in the extension direction while slidably contacting with the opposite electrode so as to clean the opposite electrode; wherein the cleaning member is configured to reciprocate along the extension direction, and a moving direction of the cleaning member is switchable between a first direction and a second direction opposite to the first direction, wherein the cleaning member comprises a sheet-like member configured to be flexible and to contact with the opposite electrode, and wherein the sheet-like member has different roughness at a first surface and a second surface that is opposite to the first surface, and when switching the moving direction of the cleaning member, that portion of the sheet-like member which contacts with the opposite electrode is switched between the first surface and the second surface.

Additional objects and advantages of the present invention will be apparent from the detailed description of the preferred embodiment, the appended claims and the accompanying drawings or may be leaned by practice of the invention.

BRIEF DESCRIPTION OF THE DRAWINGS

To better understand the claimed invention, and to show how the same may be carried into effect, reference will now be made, by way of example only, to the accompanying drawings, in which:

DETAILED DESCRIPTION OF THE EXEMPLARY EMBODIMENT

Figure 1:
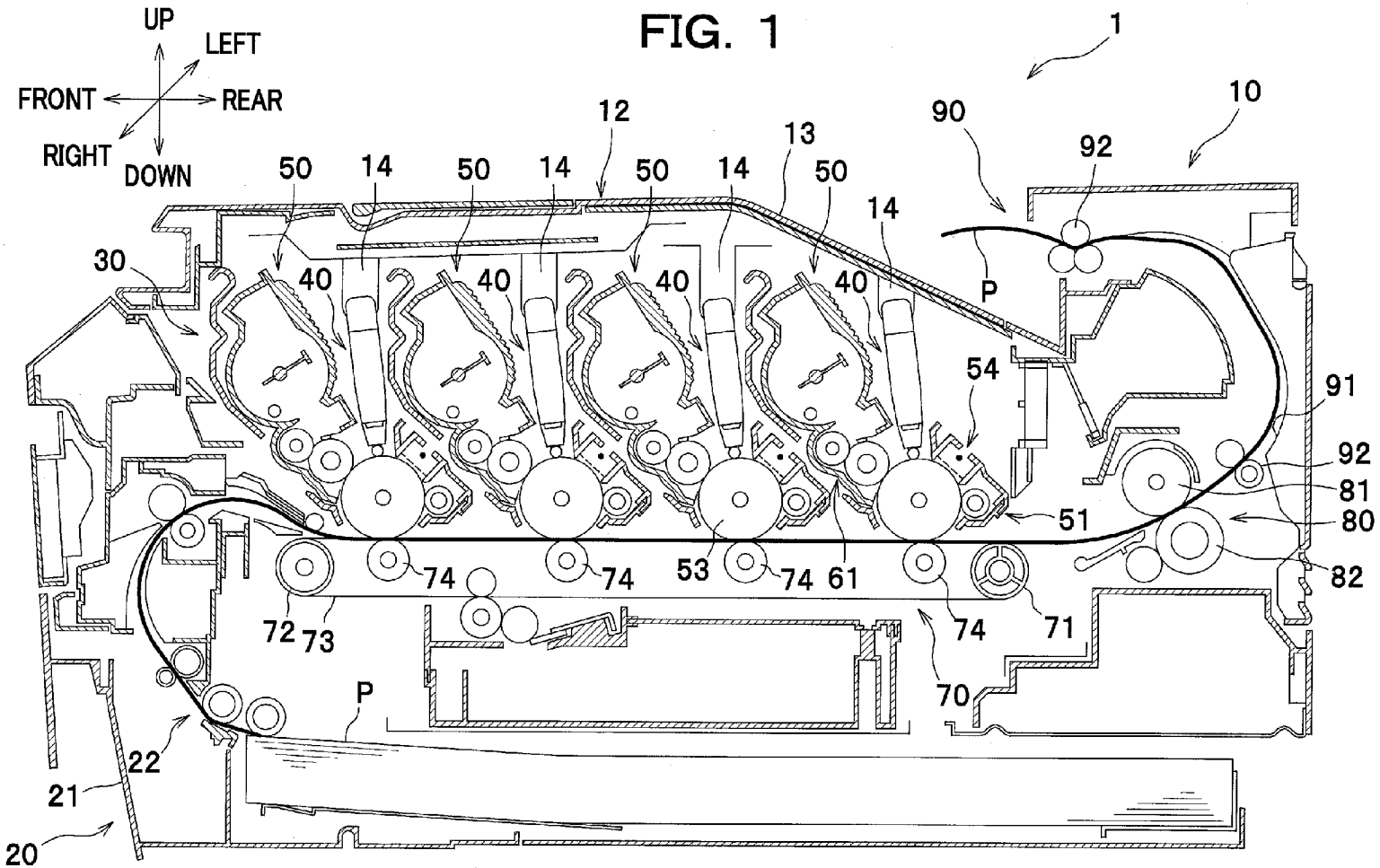
FIG. 1 is a sectional view of a color printer according to one embodiment of the present invention, illustrating an overall configuration of the color printer.

Detailed description will be given of exemplary embodiments of the present invention with reference to the accompanying drawings when necessary. In the following description, an overall configuration of a color printer will be described at first, and then characteristic configurations according to the present invention will be described in detail for the respective exemplary embodiments.

In the following description, the term "direction" indicates respective directions as viewed from a user standing in front of and facing to the color printer during its usage. To be more specific, referring to FIG. 1, a left-side and a right-side of the drawing sheet are referred to as a "front side (near side)" and a "rear side (far side)", respectively. A direction away from the viewer of the figure from the drawing sheet is referred to as a "left side", and a direction toward the viewer of the figure from the drawing sheet is referred to as a "right side", respectively. Also, an upward and downward direction in FIG. 1 is referred to as a "vertical direction" or an "upward and downward direction" as it is.

Overall Configuration of Color Printer

As seen in FIG. 1, a color printer 1 comprises a main body casing 10, and other components arranged within the main body casing 10 which mainly include a sheet feeding unit 20 configured to feed a sheet of paper P (hereinafter simply referred to as a "sheet"), an image forming unit 30 configured to form an image on the sheet P supplied from the sheet feeding unit 20, and a sheet output unit 90 configured to eject the sheet P on which the image has been formed by the image forming unit 30.

An upper cover 12 is pivotally connected to an upper part of the main body casing 10 so as to open and close an opening formed in the upper part of the main body casing 10. The upper cover 12 is pivotable in upward and downward direction around a hinge (not shown) that is provided at a rear side of the main body casing 10 and functions as a supporting point. An upper surface of the upper cover 12 is designed as a sheet output tray 13 on which sheets P ejected from the main body casing 10 are stacked and accumulated. A plurality of LED retaining members 14 are provided at a lower surface of the upper cover 12, to which a plurality of LED units 40 to be described later are mounted.

The sheet feeding unit 20 is arranged at a lower part of the main body casing 10, and mainly includes a sheet feed tray 21 configured to be detachably attached to the main body casing 10, and a sheet feed mechanism 22 configured to convey a sheet P from the sheet feed tray 21 to the image forming unit 30. In the sheet feeding unit 20, the sheet feed mechanism 22 separates a stack of sheets P stored in the sheet feed tray 21 and feeds a sheet P on one-by-one basis to the image forming unit 30.

The image forming unit 30 mainly includes four LED units 40, four process cartridges 50, a transfer unit 70, and a fixing unit 80.

Figure 2:
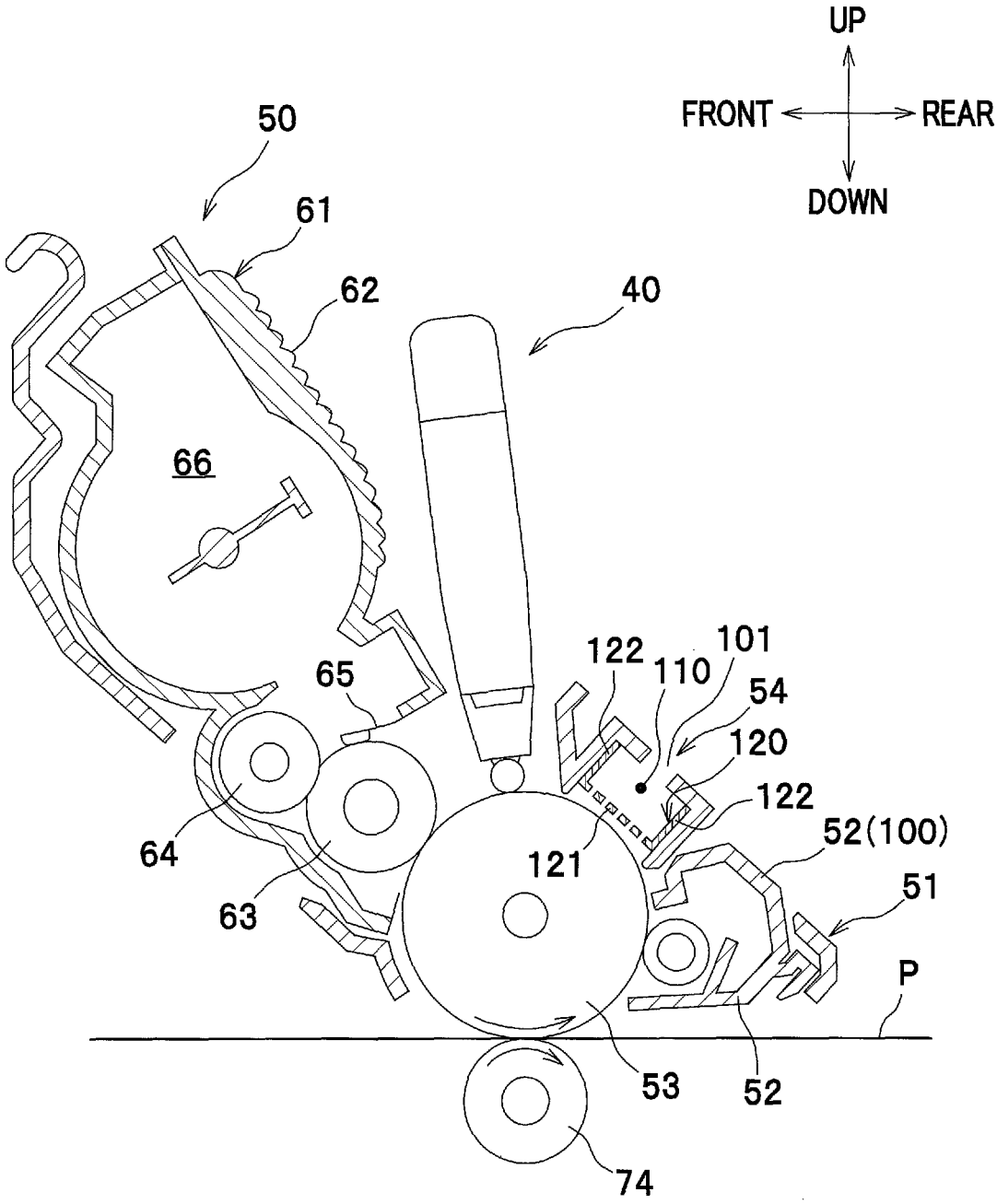
FIG. 2 is an enlarged sectional view illustrating a configuration of a process cartridge.

The process cartridges 50 are disposed between the upper cover 12 and the sheet feeding unit 20 and arranged in tandem in the front-rear direction. As seen in FIG. 2, each process cartridge 50 includes a photoconductor cartridge 51 and a development cartridge 61 detachably mounted to the photoconductor cartridge 51. The plurality of process cartridges 50 have substantially the same construction except that the color of toner stored in a toner storage chamber 66 of the corresponding development cartridge 61 is different from each other.

The photoconductor cartridge 51 mainly includes a drum case 52, a photoconductor drum 53 as an example of a photoconductor, accommodated in the drum case 52, and a charger 54.

The development cartridge 61 includes a development case 62, a developing roller 63 disposed in the development case 62, a feed roller 64 and a blade assembly 65, and a toner storage chamber 66 formed in the development case 62.

As best seen in FIG. 1, the transfer unit 70 is positioned between the sheet feeding unit 20 and the process cartridges 50, and mainly includes a drive roller 71, a driven roller 72, a conveyor belt 73, and transfer rollers 74.

The drive roller 71 and the driven roller 72 are disposed in a manner parallel to each other and separated from each other in the front-rear direction. The conveyor belt 73 in the form of an endless belt is looped around the drive roller 71 and the driven roller 72. The conveyor belt 73 has an outer surface which is in contact with the photoconductor drums 51. Four transfer rollers 74 are disposed inside the conveyor belt 73 in positions opposite to the corresponding photoconductor drums 53 so that the conveyor belt 73 is held between the transfer rollers 74 and the corresponding photoconductor drums 53. At a transfer of the image, a transfer bias is applied to each of the transfer rollers 74 under a constant current control.

The fixing unit 80 is disposed rearwardly of the process cartridges 50 and the transfer unit 70, and mainly includes a heating roller 81, and a pressure roller 82 positioned opposite to and pressed against the heating roller 81.

According to the image forming unit 30 configured as described above, the surface of each photoconductor drum 53 is uniformly charged by the corresponding charger 54, and is exposed to light that is emitted from the corresponding LED unit 40. Therefore, the electric potential of the exposed area lowers so that an electrostatic latent image associated with an image data is formed on the surface of the photoconductor drum 53.

When the feed roller 64 rotates, toner stored in the toner storage chamber 66 is supplied from the feed roller 64 onto the developing roller 63. Further, by the rotation of the developing roller 63, toner is supplied between the developing roller 63 and the blade assembly 65, so that a thin layered toner having a constant thickness is formed on the surface of the developing roller 63.

When the developing roller 63 facing to the photoconductor drum 53 contacts with the photoconductor drum 53, the toner carried on the developing roller 63 is supplied onto the electrostatic latent image formed on the photoconductor drum 53. Therefore, toner is selectively carried on the photoconductor drum 53, so that the electrostatic latent image becomes a visible image and a toner image is formed accordingly by this reversal process.

When a sheet P on the conveyor belt 73 passes through between the photoconductor drums 51 and the corresponding transfer rollers 74 disposed inside the conveyor belt 73, the toner image formed on the surface of each photoconductor drum 51 is transferred onto the sheet P. Thereafter, the sheet P passes through between the heating roller 81 and the pressure roller 82 in the fixing unit 80, whereby the toner image transferred onto the sheet P is fixed by heat.

The sheet output unit 90 includes an output-side sheet conveyance passage 91, and plural pairs of conveyor rollers 92 for conveying the sheet P along the output-side sheet conveyance passage 91. The output-side sheet conveyance passage 91 extends upwardly from an outlet of the fixing unit 80 and is then inversely directed to extend in the forward direction. The sheet P on which the toner image is transferred and thermally fixed is conveyed along the output-side sheet conveyance passage 91 by the conveyor rollers 92, and ejected from the main body casing 10 and accumulated on the sheet output tray 13.

With reference to a plurality of embodiments, a charger which is characteristic in this invention will be described below.

First Embodiment

Figure 3:
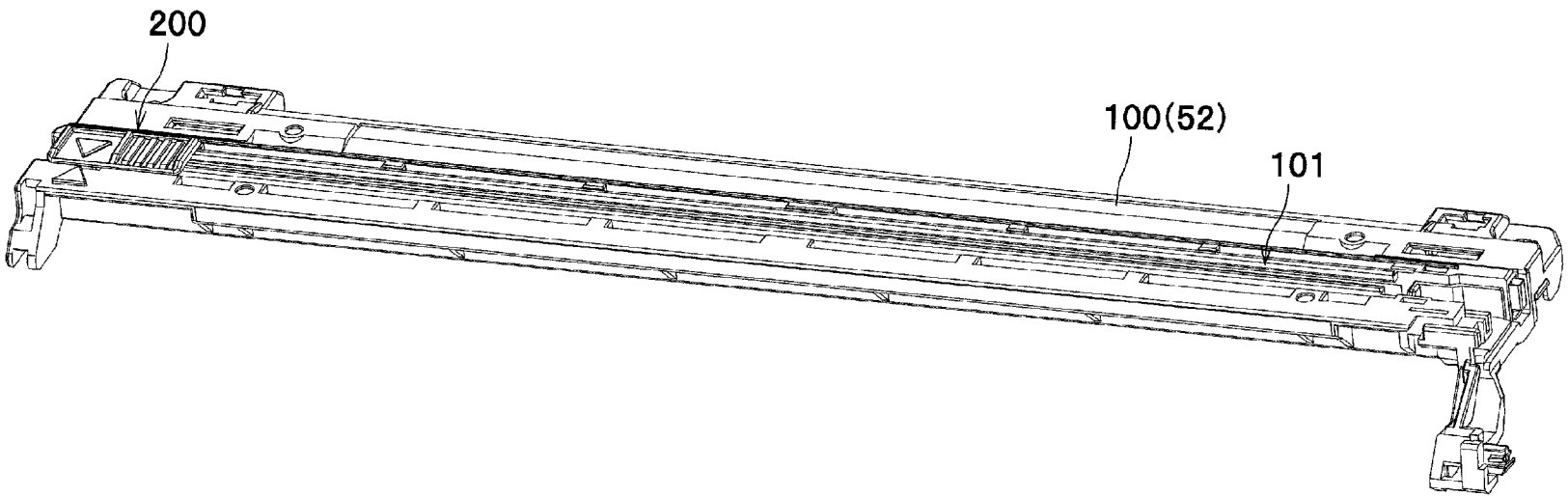
FIG. 3 is a perspective view of an upper frame to which a cleaning member is attached.

As seen in FIG. 2, a charger 54 comprises an upper frame 100 which constitutes an upper part of the drum case 52, as an example of a frame, a discharge wire 110 and an opposite electrode 120 which are supported by the upper frame 100, and a cleaning member 200 shown in FIG. 3.

The discharge wire 110 is a wire extending along an axial direction (i.e., predetermined extension direction) of the photoconductor drum 53. The discharge wire 110 is disposed in a longitudinal groove 101 (see FIG. 3) that is formed in the upper frame 100, and both ends of the discharge wire 110 are supported by the upper frame 100.

The opposite electrode 120 is a plate-like electrode extending along the axial direction of the photoconductor drum 53, and both ends of the opposite electrode 120 are bent to have a U-shaped section for facing and surrounding the discharge wire 110. The opposite electrode 120 mainly includes a grid electrode 121, and a pair of shield electrodes 122.

The grid electrode 121 is an electrode disposed between the discharge wire 110 and the photoconductor drum 53. The grid electrode 121 is formed as a plurality of wires by cutting slits in a bottom portion of the U-shaped opposite electrode 120.

The pair of shield electrodes 122 are disposed along a moving direction of the photoconductor drum 53 with the discharge wire 110 interposed between them. In other words, the shield electrodes 122 are positioned opposite (facing) to each other with the discharge wire 110 interposed between them. The term "moving direction of the photoconductor drum 53" indicates a moving direction of that portion of the photoconductor drum 53 which faces to the grid electrode 121; namely, in FIG. 2, a diagonally forward and upward direction corresponds to this moving direction.

Figure 4:
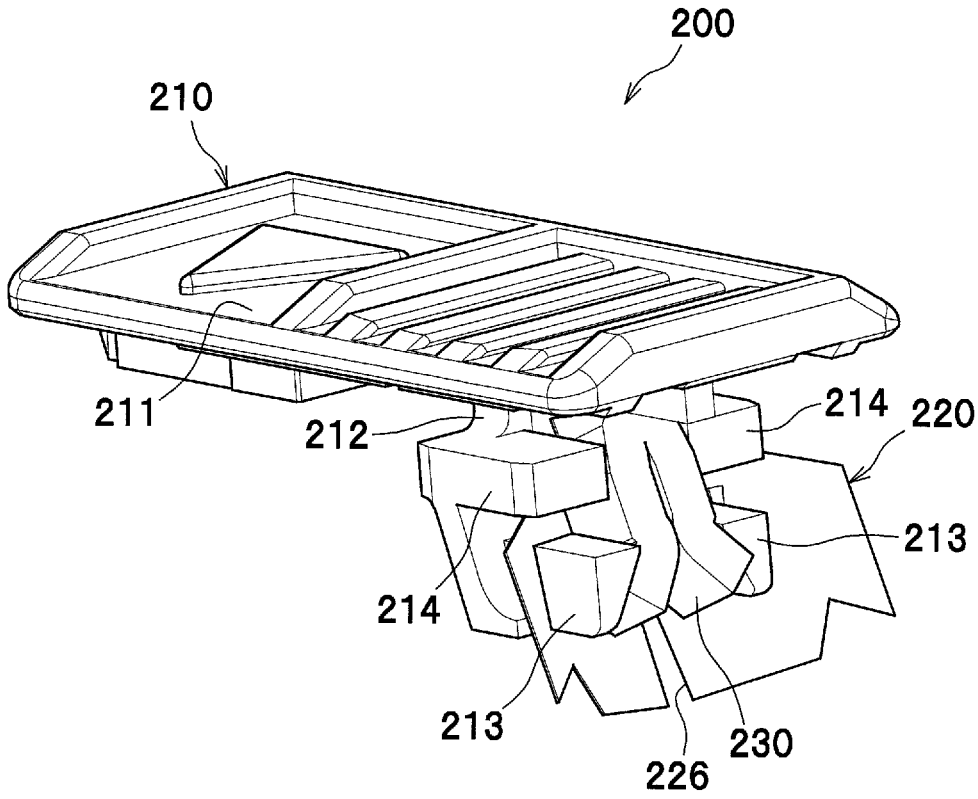
FIG. 4 is a perspective view illustrating a cleaning member according to a first embodiment.

As best seen in FIG. 3, the cleaning member 200 is slidably mounted in the longitudinal groove 101 of the upper frame 100. The cleaning member 200 moves in the longitudinal groove 101 while slidably contacting with the discharge wire 110 and the opposite electrode 120 (see FIG. 2), so as to clean the discharge wire 110 and the opposite electrode 120. To be more specific, as best seen in FIG. 4, the cleaning member 200 comprises a support member 210, a film 220 as an example of a sheet-like member, and a block sponge 230 as an example of a contact member.

Figure 5:
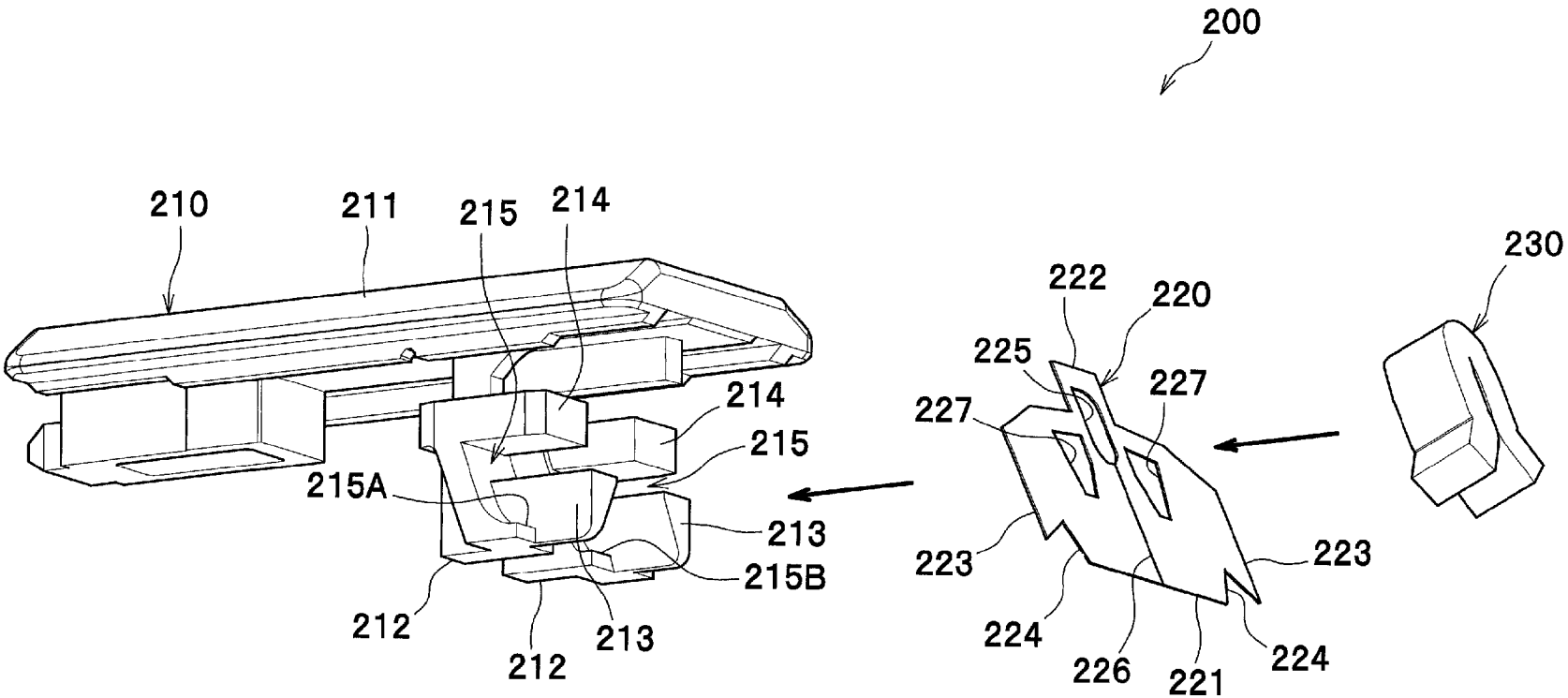
FIG. 5 is an exploded perspective view illustrating the cleaning member according to the first embodiment.

As seen in FIG. 5, the support member 210 mainly includes a manipulation portion 211 in the form of a substantially rectangular flat plate, and two flexible arm portions 212 extending downwardly from a lower surface of the manipulation portion 211. Each arm portion 212 has a first projection 213, a second projection 214, and a recess portion 215, for the purpose of supporting the film 220 and the block sponge 230.

The first projection 213 is in the form of a substantially triangular prism. The first projection 213 protrudes through an engagement hole 227 formed in the film 220, and supports the film 220. To be more specific, each of the first projections 213 supports one of or the other one of halves of the film 220 divided by a slit 226 to be described later. The first projections 213 function to hold the block sponge 230 that is folded into a substantially U-shaped configuration and to prevent both ends of the folded block sponge 230 from being spread open in a direction away from each other.

The second projection 214 is in the form of a quadrangular prism. The second projections 214 nip and support a folded-back portion of the substantially U-shaped block sponge 230.

Figure 10:
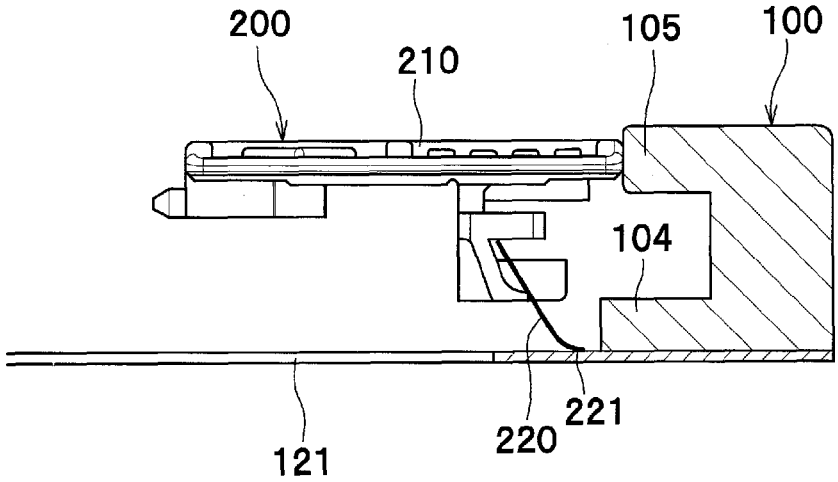
FIG. 10 is a sectional view illustrating a state in which the cleaning member according to the first embodiment is in contact with the upper frame.

The recess portion 215 extends to surround the periphery of the first projection 213, and is formed such that a depth of the recess portion 215 increases gradually from a distal end to a proximal end of the arm portion 212. Namely, the recess portion 215 has a slant surface extending from the distal end to the proximal end of the arm portion 212 and slanting toward one longitudinal side of the manipulation portion 211. Thereby, as best seen in FIG. 10, the film 220 pressed against the recess portion 215 is supported obliquely by the support member 210 in such a manner that the distal end 221 and the proximal end 222 of the film 220 are arranged in different positions (i.e., not overlapped from each other) as viewed from above with respect to the extension direction of the discharge wire 110.

Figure 6:
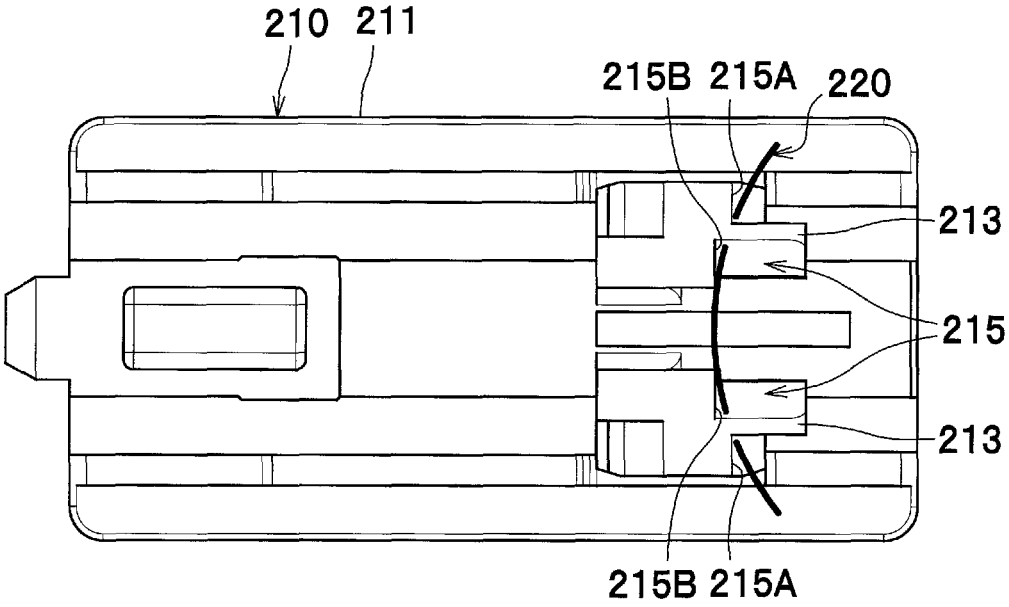
FIG. 6 is a sectional explanatory view, in which the cleaning member according to the first embodiment is looked up from below and a film is cut around first projections.

As best seen in FIG. 6, the recess portion 215 has open ends 215A, 215B, between which the first projection 213 is positioned. Of these open ends 215A, 215B, the open end 215A that is positioned outwardly of the first projection 213 is arranged one level higher than the open end 215B that is positioned inwardly of the first projection 213; in other words, the open end 215A and the open end 215B are arranged at different levels in the extension direction such that the open end 215A protrudes from the arm portion 212 and the distance from the open end 215A to the film 220 is shorter than the distance from the open end 215B to the film 220. With this arrangement, as seen in FIG. 6, the film 220 pressed against the recess portion 215 curves as viewed from a direction connecting the distal end 221 and the proximal end 222. In other words, the film 220 is supported in a curved state such that a center part of the film 220 where a slit 226 is formed is more recessed toward the recess portion 215 than both side ends 223 of the film 220.

For better understanding of the curved state of the film 220, in FIG. 6, only the film 220 is shown as a section by cutting the film 220 around the first projections 213.

As seen in FIG. 5, the film 220 is made of a deformable material such as polyethylene terephthalate (PET). The film 220 has the distal end 221 at which the film 220 contacts with the grid electrode 121 (see FIG. 2), the proximal end 222 which is positioned opposite to the distal end 221, and a pair of opposite side ends 223 arranged in a direction orthogonal to the direction connecting the distal end 221 and the proximal end 222. The pair of side ends 223 are configured to frictionally contact with the pair of shield electrodes 122 (see FIG. 2) when the cleaning member 200 is slidably mounted in the upper frame 100. With this arrangement, the film 220 that has been supported in a curved state by the recess portions 215 curves deeply toward a center of the recess portions 215.

A notch 224 is formed in the film 220 between the distal end 221 and each of the side ends 223. The provision of the notches 224 at both side ends 223 is advantageous because the distal end 221 and the both side ends 223 are free from each other from deformation caused by flexing the film 220 and thus allows the distal end 221 and the both side ends 223 of the film 220 to contact with the grid electrode 121 and the shield electrodes 122 with a high degree of accuracy.

A hole 225 for inserting the discharge wire 110 (see FIG. 2) is formed in the film 220, and a slit 226 is formed in the film 220 which extends from the hole 225 and reaches to the distal end 221, extending along the extension direction of the discharge wire 110. The hole 225 is formed so as not to be symmetrical with respect to the slit 226. This is to avoid a wrong assembly of the film 220 that may occur when assembling the film 220 upside down. Therefore, even if the film 220 is visibly checked and assembled, an accurate assembly of the film 220 can be performed while avoiding the film 220 being placed on burrs that are formed around the hole 225 and the like on the reverse surface of the film 220.

In place of changing the shape of the hole 225, it is also possible to avoid a wrong assembly by changing shapes of the left-side first projection 213 and the right-side first projection 213, and further by changing shapes of engagement holes 227 to be described later in accordance with the shapes of these first projections 213. Dedicated structure for preventing a wrong assembly may be provided; for example, the support member 210 has a projection at one side with respect to the slit 226, and the film 220 has a corresponding hole into which the projection is inserted.

Figure 7A:
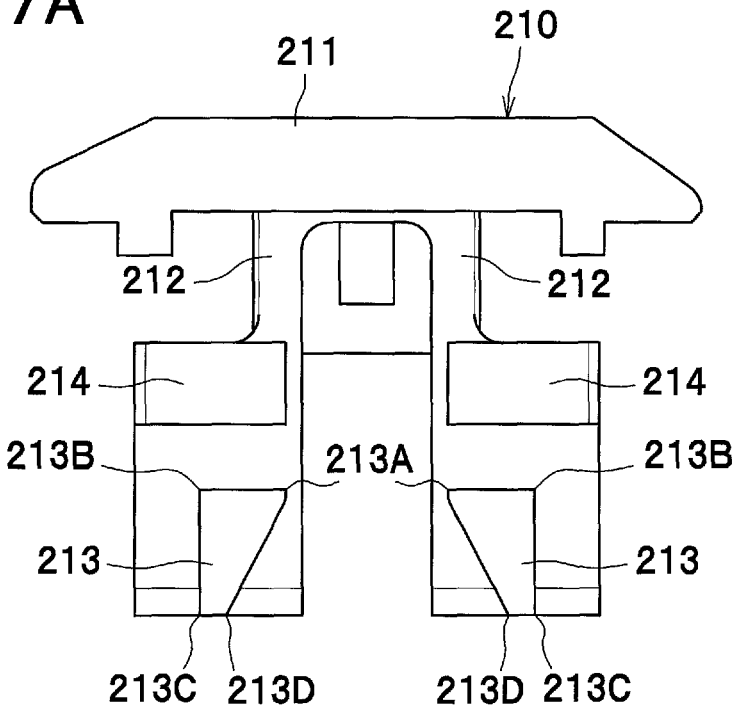
FIG. 7A is a front view of a support member as viewed from a front side of the first projections.
Figure 7B:
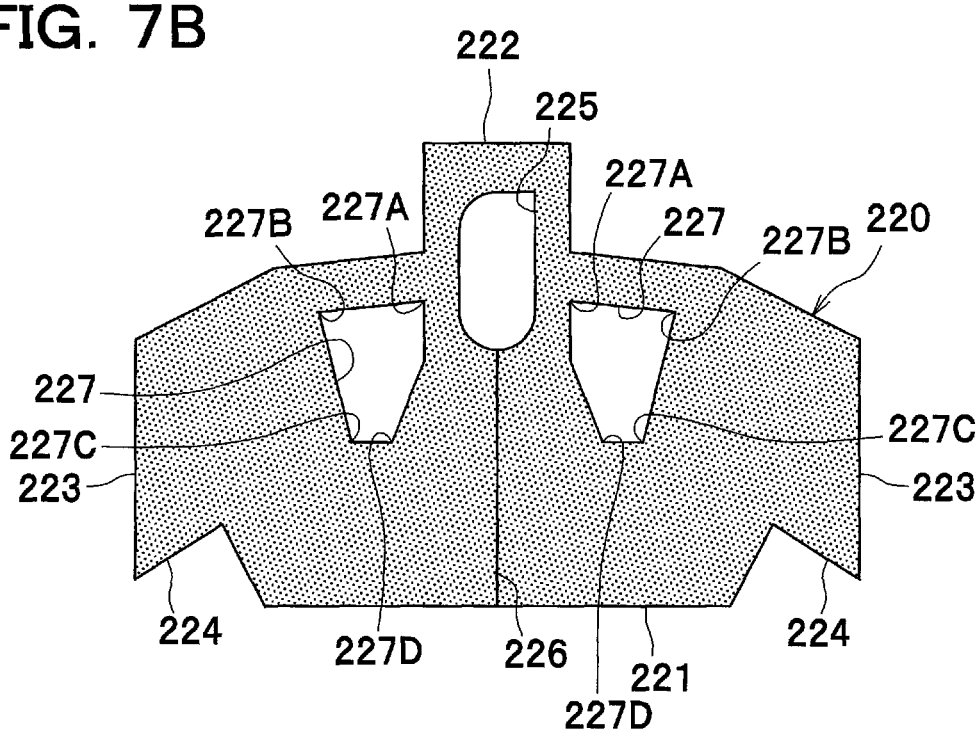
FIG. 7B is a plan view of the film.

Further, a pair of engagement holes 227 are formed in the film 220 on both sides of the slit 226 and in positions symmetrical with respect to the slit 226. As best seen in FIGS. 7A and 7B, each of the engagement holes 227 has three corners 227A, 227B, 227C corresponding to and configured to be engageable with three corners 213A, 213B, 213C of the first projection 213 of the support member 210.

The three corners 227A, 227B, 227C are formed in positions slightly rotated from the positions of the three corresponding corners 213A, 213B, 213C. To be more specific, this rotating direction is opposite to the direction where the slit 226 opens (i.e., direction where one half and the other half of the film 220 divided by the slit 226 are moved away from each other along a circular trajectory with the proximal end 222 of the film 220 being the center of rotation).

More specifically, the three corners 227A, 227B, 227C of the engagement hole 227 formed in the left half of the film 220 shown in FIG. 7B are arranged in positions rotated anticlockwise from the corresponding positions of the three corners 213A, 213B, 213C of the first projection 213 provided on the left arm portion 212 shown in FIG. 7A. On the contrary, the three corners 227A, 227B, 227C of the engagement hole 227 formed in the right half of the film 220 shown in FIG. 7B are arranged in positions rotated clockwise from the corresponding positions of the three corners 213A, 213B, 213C of the first projection 213 provided on the right arm portion 212 shown in FIG. 7A. Therefore, when mounting the film 220 on the support member 210 by inserting the first projections 213 into the corresponding engagement holes 227, the corners 227A, 227B, 227C move to the positions of and conform with the corresponding corners 213A, 213B, 213C to thereby slightly open the slit 226 as shown in FIG. 4. Namely, the slit 226 is opened due to a difference in shape of the corresponding mounting portions (i.e., the first projections 213 and the engagement holes 227) of the arm portions 212 and the film 220.

As seen in FIG. 5, the block sponge 230 is a contact member configured to slidably contact with the discharge wire 110 (see FIG. 2) in the extension direction. The block sponge 230 is folded into a substantially U-shaped configuration and supported on the support member 210 between the second projections 214. Since the second projections 214 nip and support the block sponge 230, the film 220 is disposed and held between the block sponge 230 and the support member 210.

Figure 8:
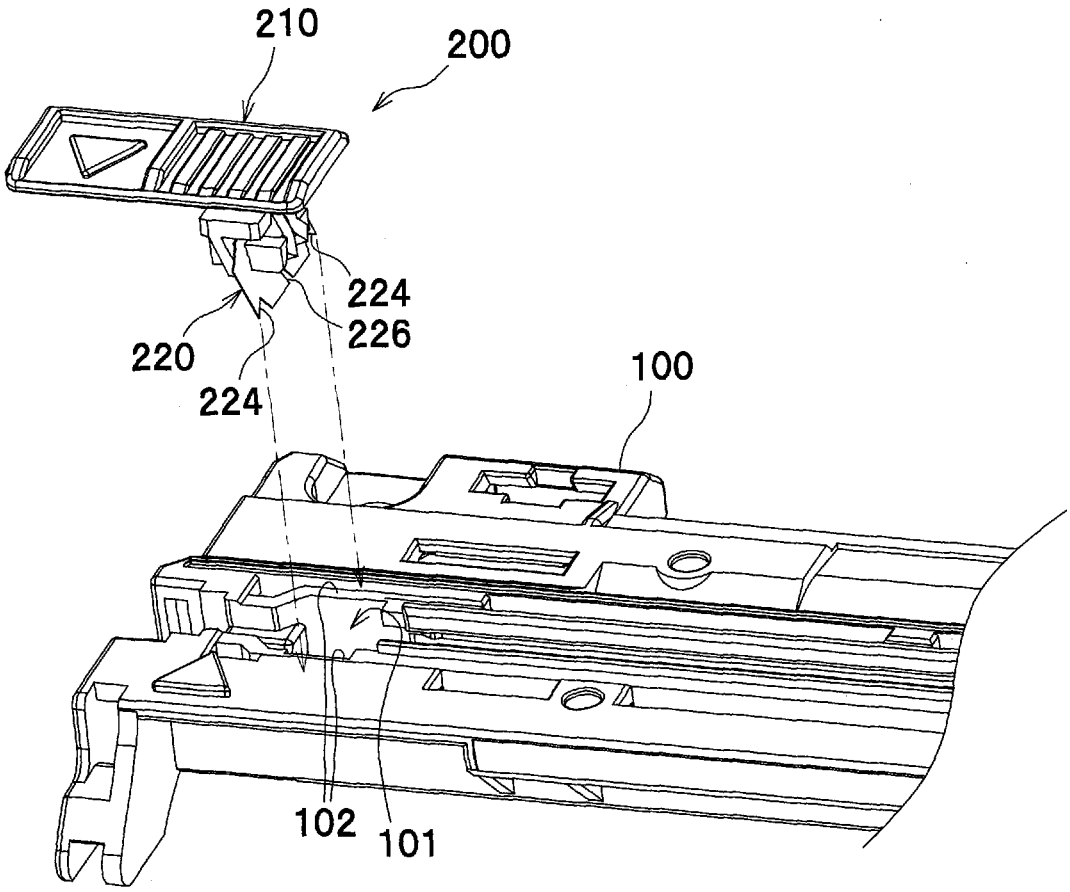
FIG. 8 is an exploded perspective view, illustrating a state in which the cleaning member according to the first embodiment is being mounted to the upper frame.

As best seen in FIG. 8, a pair of engagement walls 102 (only one of them is shown in the figure) are formed at one end side of the longitudinal groove 101 formed in the upper frame 100. The engagement walls 102 are configured to protrude inwardly from a pair of side walls that form the longitudinal groove 101. When mounting the cleaning member 200 into the longitudinal groove 101, the notches 224 of the film 220 are brought into contact with the corresponding engagement walls 102, so that the slit 226 of the film 220 is more widely open, allowing the discharge wire 110 to be smoothly inserted into the hole 225.

Figure 9A:
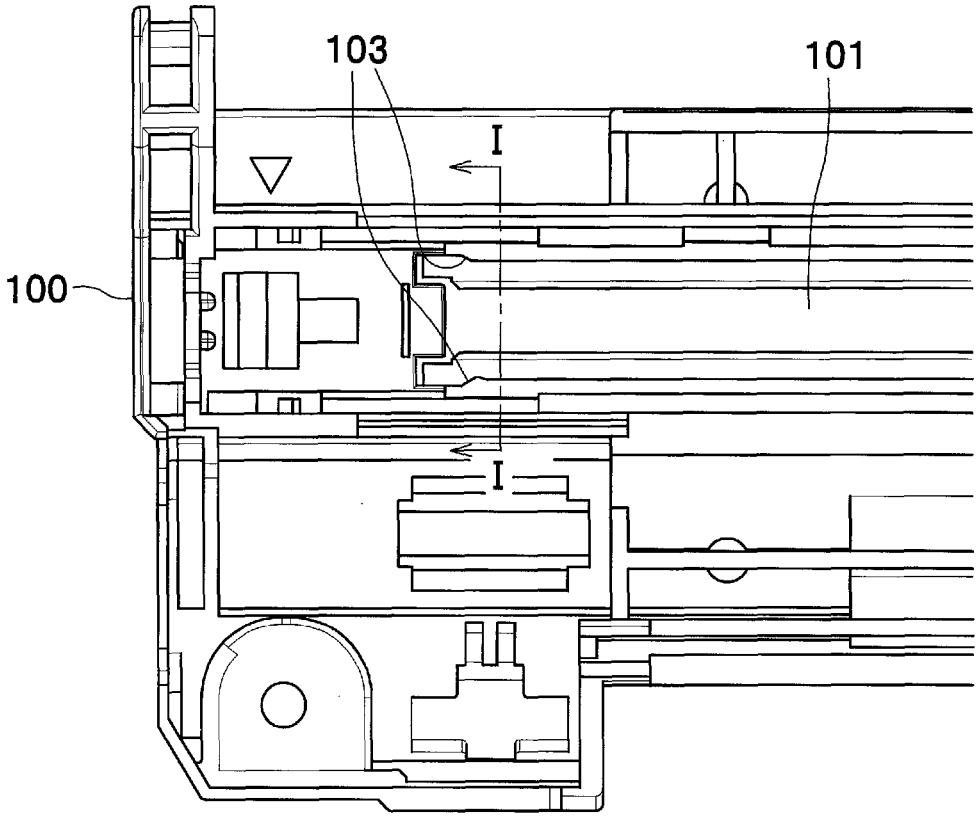
FIG. 9A is a bottom view of the upper frame as viewed from below, illustrating a state in which a discharge wire, an opposite electrode and the cleaning member are removed.
Figure 9B:
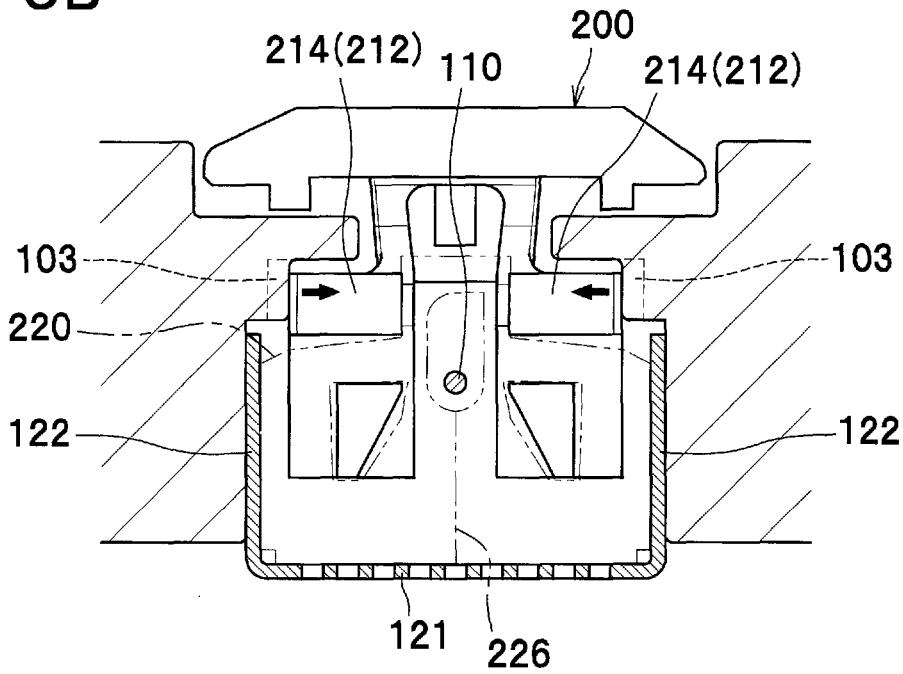
FIG. 9B is a sectional view of the upper frame taken along the line I-I of FIG. 9A, illustrating a state in which the discharge wire, the opposite electrode and the cleaning member are mounted to the upper frame.

Further, as best seen in FIGS. 9A and 9B, a pair of tapered surfaces 103 are formed in the longitudinal grove 101 of the upper frame 100, by which the arm portions 212 (more specifically, the second projections 214) of the support member 210 are urged inwardly to move toward each other. With this arrangement, when inserting the cleaning member 200 from one end side (i.e., from the engagement walls 102 side) of the longitudinal groove 101 and thereafter sliding the same toward the other side of the longitudinal groove 101, as seen in FIG. 9B, the arm portions 212 of the support member 210 are urged inwardly to move toward each other to thereby close the slit 226 of the film 220. To be more specific, the pair of tapered surfaces 103 urge the arm portions 212 (second projections 214) to move toward each other, and thereby the two corners 213A, 213D (see FIG. 7A) integrally formed on the first projection 213 of each arm portion 212 urge the corresponding two corners 227A, 227D of each engagement hole 227 of the film 220 inwardly toward each other. This causes the slit 226 of the film 220 to be closed. Therefore, when the cleaning member 200 is in a cleaning position for cleaning the grid electrode 121, the slit 226 is closed and the film 220 slidably contacts with the whole surface of the grid electrode 121. It is thus possible to satisfactorily clean the grid electrode 121. Further, since the block sponge 230 (see FIG. 4) is compressed when the arm portions 212 of the support member 210 are urged inwardly to move toward each other, the block sponge 230 can frictionally and slidably contact with the discharge wire 110 to thereby satisfactorily clean the discharge wire 110.

Further, as best seen in FIG. 10, an engagement portion 105 is provided on the other end side of the upper frame 100, and the support member 210 comes into abutment against the engagement portion 105 as soon as the distal end 221 of the film 220 reaches closer to a part of the upper frame 100, namely, in the vicinity of a restriction portion 104 for restricting electric discharge at the grid electrode 121. To be more specific, when the support member 210 is brought into abutment against the engagement portion 105, a small gap is formed between the distal end 221 of the film 220 and the restriction portion 104.

With this arrangement, when the cleaning member 200 is slid along the extension direction with the distal end 221 of the film 220 facing forward in a first direction, it is possible to prevent the distal end 221 of the film 220 from hitting the restriction portion 104 and being bent as well as to satisfactorily clean that portion of the grid electrode 121 which performs electric discharge (i.e., non-contacting portion of the grid electrode 121 that is not in contact with the restriction portion 104).

According to the charger 54 in the first embodiment, the following advantageous effects can be expected.

Since the film 220 is supported obliquely with respect to the grid electrode 121 and contacts with the grid electrode 121 at the distal end 221, when the cleaning member 200 is moved along the extension direction with the distal end 221 of the film 220 facing forward in the first direction (e.g., first passage for cleaning), the distal end 221 of the film 220 can frictionally scrape off and remove foreign objects adhering to the surface of the grid electrode 121. On the contrary, when the cleaning member 200 is moved along the extension direction with the distal end 221 of the film 220 facing rearward in a second direction opposite to the first direction (e.g., second passage for cleaning), the distal end 221 of the film 220 undergoes deflection and a curved portion of the distal end 221 can gently clean foreign objects (which are not fixed) on the grid electrode 121, which leads to decreased sliding resistance of the cleaning member 200 and hence to improvement in the operability of the cleaning member 200.

Since the film 220 is supported on the support member 210 in such a manner that the film 220 curves as viewed from a direction connecting the distal end 221 and the proximal end 222, the rigidity of the film 220 can be improved in a simple manner without requiring reinforcement frames or the like. To be more specific, according to an arrangement such as disclosed in this embodiment in which the film 220 is disposed obliquely with respect to the grid electrode 121, the distal end 221 of the film 220 can strongly and frictionally scrape off foreign objects adhering to the grid electrode 121. However, the film 220 may be disadvantageously bent due to frictional resistance encountered during the cleaning operation. Supporting the film 220 in a curved state can enhance the rigidity of the film 220 during the cleaning operation.

Since the notches 224 are formed in the film 220 between the distal end 221 and the both side ends 223, the distal end 221 and the both side ends 223 of the film 220 are free from each other from deformation caused by flexing the film 220. Therefore, it is possible for the distal end 221 and the both side ends 223 of the film 220 to contact with the grid electrode 121 and the shield electrodes 122 with a high degree of accuracy.

Since the cleaning member 200 includes the block sponge 230 for cleaning the discharge wire 110 and the film 220 for cleaning the opposite electrode 120, the discharge wire 110 and the opposite electrode 120 can be cleaned simultaneously by sliding the cleaning member 200 along the extension direction of the discharge wire 110. Further, since the film 220 is disposed and held between the support member 210 and the block sponge 230, the block sponge 230 for cleaning the discharge wire 110 can also function as a disengagement preventing member for the film 220, which prevents the film 220 from being disengaged from the support member 210. This reduces the number of constituent parts.

When mounting the cleaning member 200 to the upper frame 100, the notches 224 of the film 220 are brought into contact with the upper frame 100, so that the slit 226 is more widely open. This allows the discharge wire 110 to be smoothly inserted and set into the hole 225 through the open slit 226, thereby simplifying the attachment of the cleaning member 200.

The pair of tapered surfaces 103 of the upper frame 100 urge the arm portions 212 of the support member 210 to move toward each other, so that the open slit 226 is closed. Therefore, the distal end 221 of the film 220 slidably contacts with the grid electrode 121 in a preferable manner.

Although the present invention has been described in detail with reference to the above first embodiment, the present invention is not limited to this specific embodiment and various changes and modifications as described below may be made without departing from the scope of the appended claims.

In the first embodiment as described above, the film 220 is configured such that the notches 224 are brought into contact with the corresponding engagement walls 102 of the upper frame 100. However, the present invention is not limited to this specific embodiment. For example, the notches may be formed so as not to contact with the engagement walls 102. In this arrangement, too, when the first projections 213 of the support member 210 are inserted into the corresponding engagement holes 227 of the film 220, the slit 226 can be opened. Therefore, the discharge wire 110 can be inserted into the hole 225 through this open slit 226.

In the first embodiment as described above, the film 220 is configured to slidably contact with both the grid electrode 121 and the pair of shield electrodes 122. However, the present invention is not limited to this specific embodiment. For example, the film 220 may be configured to slidably contact with either one of the grid electrode and the shield electrodes.

In the first embodiment as described above, the film 220 as an example of a sheet-like member is made of polyethylene terephthalate (PET). However, the present invention is not limited to this specific embodiment. For example, the film 220 may be made of other resin films or paper.

In the first embodiment as described above, the notch 224 is formed as a V-shaped recess. However, the notch may be formed as a slit.

In the first embodiment as described above, the block sponge 230 is employed as a contact member. However, as an alternative, a felt block may be employed.

In the first embodiment as described above, the present invention is adapted to the color printer 1. However, the present invention may be adapted to other image forming apparatuses, such as a copying machine and a multifunction device.

In the first embodiment as described above, the photoconductor drum 53 is employed as a photoconductor. However, as an alternative, a belt-type photoconductor may be employed.

Figure 11A:
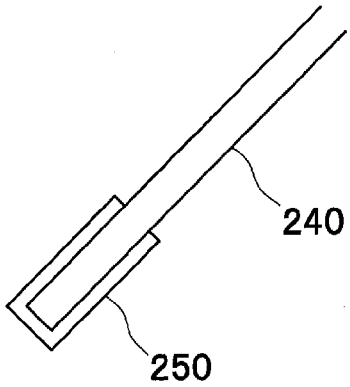
FIGS. 11A and 11B are explanatory views illustrating modifications, in which a contact member for the opposite electrode is bonded to a distal end of a sheet-like member.
Figure 11B:
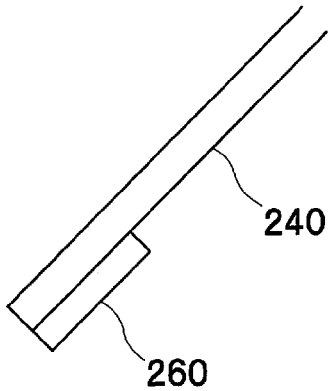

As best seen in FIGS. 11A and 11B, contact members 250, 260 for the opposite electrode may be provided at a proximal end of a sheet-like member 240, and the sheet-like member 240 may slidably contact with the opposite electrode 120 at the contact members 250, 260. For example, as shown in FIG. 11A, the contact member 250 is mounted on the sheet-like member 240 so as to wound at the distal end of the sheet-like member 240; that is, the contact member 250 is folded into a U-shaped configuration and attached to the sheet-like member 240 so that the contact member 250 extends from an upper surface to a lower surface of the sheet-like member 240 through the distal end. As an alternative, as shown in FIG. 11B, the contact member 260 may be attached to one surface (surface facing to the opposite electrode 120) of the sheet-like member 240.

The sheet-like member 240 may be a film member made of polyethylene terephthalate (PET), and the contact member 250, 260 for the opposite electrode may be made of urethane sponge (elastic member) or a sand paper (abrasive member). In the case where a urethane sponge is used for the contact member 250, 260, the contact member 250, 260 closely contacts with the opposite electrode 120, so that the wipe-off efficiency for foreign objects can be further improved. On the other hand, in the case where a sand paper is used for the contact member 250, 260, the scrape-off efficiency for foreign objects adhering to the opposite electrode 120 can be further improved. This is advantageous because gummed foreign objects adhered to the opposite electrode 120 can be removed.

Second Embodiment

A charger according to the second embodiment will be described below.

Figure 12:
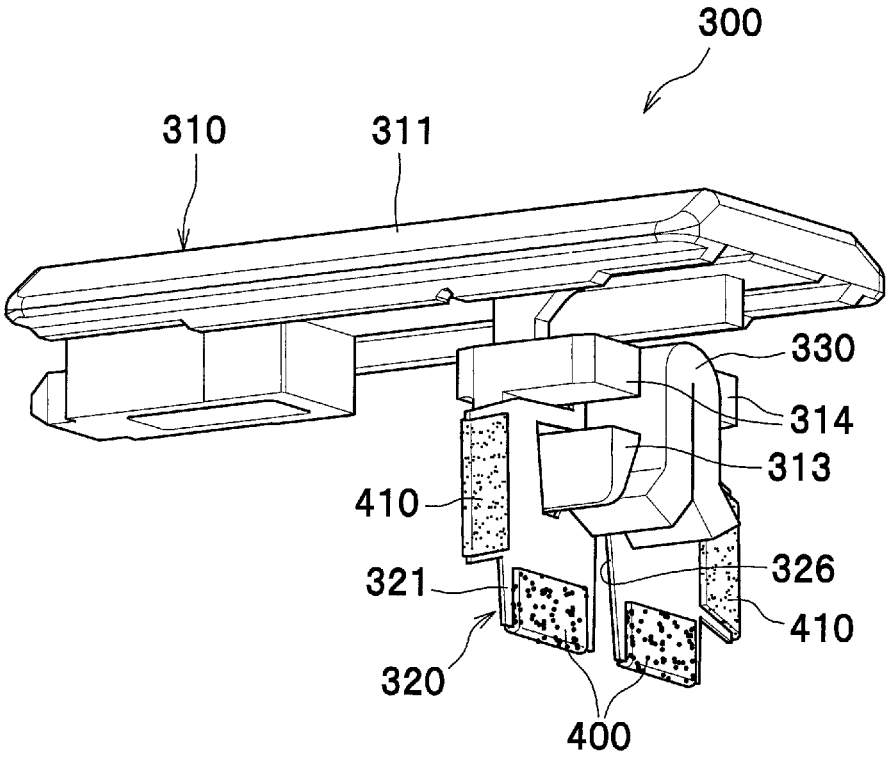
FIG. 12 is a perspective view illustrating a cleaning member according to a second embodiment.

A charger 54 according to the second embodiment comprises the upper frame 100 (electrically insulative), the discharge wire 110 and the opposite electrode 120, which are substantially identical with those of the first embodiment, and a cleaning member 300 shown in FIG. 12.

The cleaning member 300 is slidably mounted in the longitudinal groove 101 of the upper frame 100. The cleaning member 300 moves in the longitudinal groove 101 while slidably contacting with the discharge wire 110 and the opposite electrode 120 (see FIG. 2), so as to clean the discharge wire 110 and the opposite electrode 120. To be more specific, as best seen in FIG. 12, the cleaning member 300 comprises a support member 310, a film 320 as an example of a sheet-like member, and a block sponge 330 as an example of a contact member.

Figure 13:
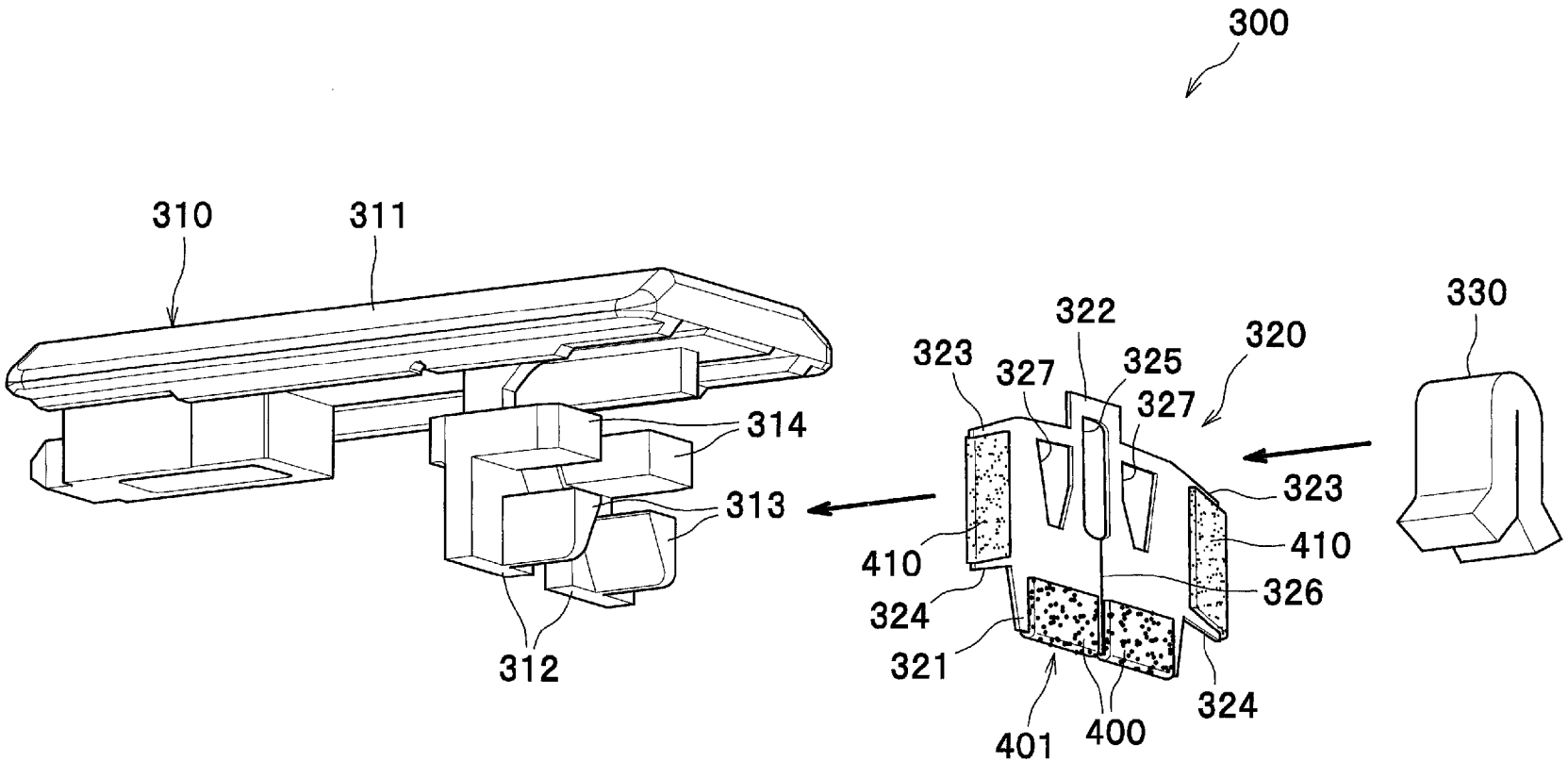
FIG. 13 is an exploded perspective view illustrating the cleaning member according to the second embodiment.

As seen in FIG. 13, the support member 310 mainly includes a manipulation portion 311 in the form of a substantially rectangular flat plate, and two flexible arm portions 312 extending downwardly from a lower surface of the manipulation portion 311. Each arm portion 312 has a first projection 313 and a second projection 314, for the purpose of supporting the film 320 and the block sponge 330.

The first projection 313 is in the form of a substantially triangular prism. The first projection 313 protrudes through an engagement hole 327 formed in the film 320, and supports the film 320. To be more specific, each of the first projections 313 supports one of or the other one of halves of the film 320 divided by a slit 326 to be described later. The first projections 313 function to hold the block sponge 330 that is folded into a substantially U-shaped configuration and to prevent both ends of the folded block sponge 330 from being spread open in a direction away from each other.

The second projection 314 is in the form of a quadrangular prism. The second projections 314 nip and support a folded-back portion of the substantially U-shaped block sponge 330.

As seen in FIG. 13, the film 320 is made of a deformable material such as polyethylene terephthalate (PET). The film 320 is supported in a substantially upright position by the support member 310. The film 320 has a distal end 321 which is positioned closer to the grid electrode 121 (see FIG. 2), a proximal end 322 which is positioned opposite to the distal end 321, and a pair of opposite side ends 323 arranged in a direction orthogonal to the direction connecting the distal end 321 and the proximal end 322 and positioned closer to the pair of shield electrodes 122 (see FIG. 2).

Figure 14A:
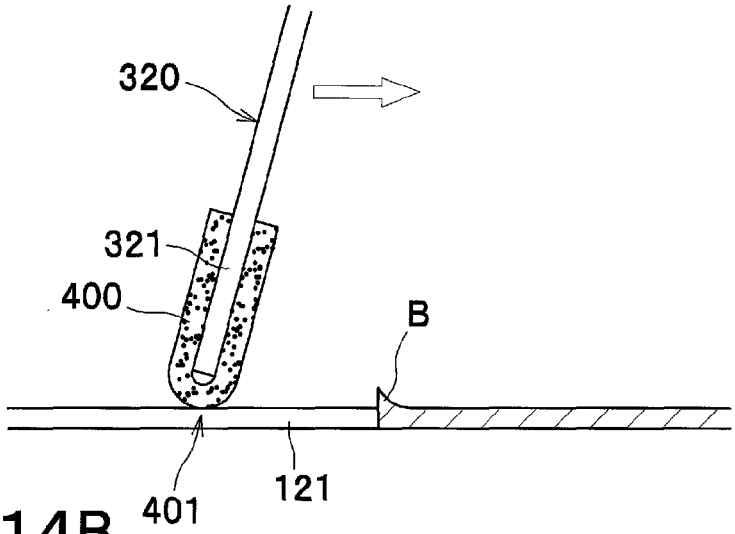
FIG. 14A is a sectional view illustrating a state in which the cleaning member according to the second embodiment is being moved toward a burr.
Figure 14B:
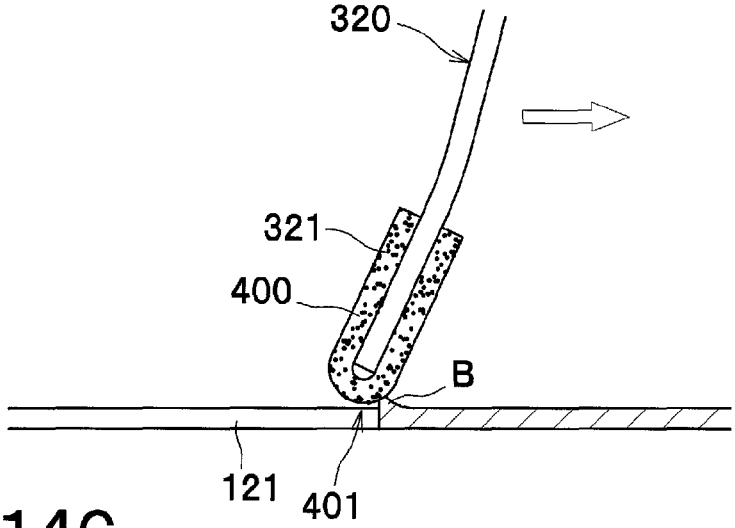
FIG. 14B is a sectional view illustrating a state in which the cleaning member is being moved across the burr.
Figure 14C:
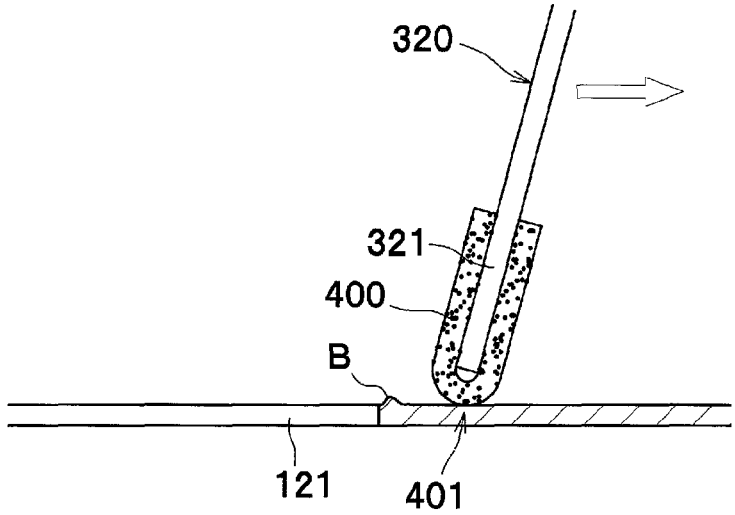
FIG. 14C is a sectional view illustrating a state in which objects adhering to the burr has been scraped off by the cleaning member.

A film-like abrasive member 400 as an example of a contact member is fixed to the distal end 321 of the film 320. The film-like abrasive member 400 is folded to surround the distal end 321 of the film 320, so that as seen in FIGS. 14A to 14C, the abrasive member 400 contacts with the grid electrode 121 at its folded portion 401. Therefore, when moving the cleaning member 300 in the extension direction of the discharge wire 110, the folded portion 401 of the abrasive member 400 smoothly moves across a burr B without being trapped by the burr B, so that foreign objects (toner, etc.) adhering to the surface of the grid electrode 121 can be scraped off by the abrasive member 400.

The film-like abrasive member 400 may be made of any known member as long as it has a surface sufficient for scraping off objects adhering to the grid electrode 121. For example, a sheet-like metal file or a sand paper may be employed.

As best seen in FIG. 13, a film-like felt member 410 as an example of a wipe-off member is fixed to each of the side ends 323 of the film 320. The felt member 410 is made of a porous material, and is folded to surround the side end 323. Therefore, when moving the cleaning member 300 in the extension direction of the discharge wire 110, the pair of felt members 410 slidably contact with the corresponding shield electrodes 122, so that foreign objects adhering to the shield electrodes 122 can be satisfactorily scraped off by the felt members 410.

The abrasive member 400 and the felt members 410 are strongly pressed against the grid electrode 121 and the shield electrodes 122, respectively, by means of the flexurally deformed film 320. Therefore, since the abrasive member 400 is strongly pressed against the grid electrode 121 and the felt members 410 are strongly pressed against the shield electrodes 122, gummed foreign objects (toner, etc.) adhering to the grid electrode 121 and the shield electrodes 122 can be satisfactorily scraped off.

A notch 324 is formed in the film 320 between the distal end 321 and each of the side ends 323. The provision of the notches 324 at both side ends 323 is advantageous because the distal end 321 and the both side ends 323 are free from each other from deformation caused by flexing the film 320 and thus allows the distal end 321 and the both side ends 323 of the film 320 to contact with the grid electrode 121 and the shield electrodes 122 with a high degree of accuracy.

A hole 325 for inserting the discharge wire 110 (see FIG. 2) is formed in the film 320, and a slit 326 is formed in the film 320 which extends from the hole 325 and reaches to the distal end 321. The hole 325 is formed so as not to be symmetrical with respect to the slit 326. This is to avoid a wrong assembly of the film 320 that may occur when assembling the film 320 upside down. Therefore, even if the film 320 is visibly checked and assembled, an accurate assembly of the film 320 can be performed while avoiding the film 220 being placed on burrs that are formed around the hole 325 and the like on the reverse surface of the film 320.

In place of changing the shape of the hole 325, it is also possible to avoid a wrong assembly by changing shapes of the left-side first projection 313 and the right-side first projection 313, and further by changing shapes of engagement holes 327 to be described later in accordance with the shapes of these first projections 313. Dedicated structure for preventing a wrong assembly may be provided; for example, the support member 310 has a projection at one side with respect to the slit 326, and the film 320 has a corresponding hole into which the projection is inserted.

Figure 15A:
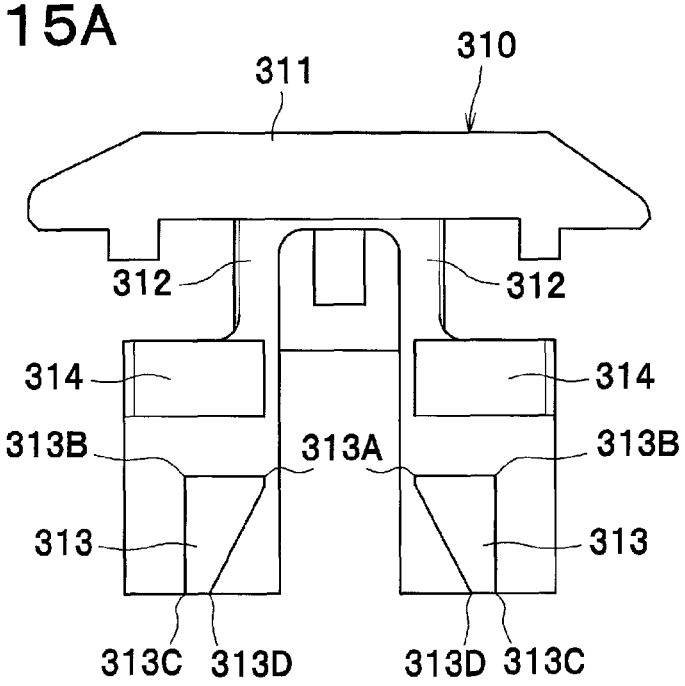
FIG. 15A is a front view of a support member as viewed from a front side of first projections.
Figure 15B:
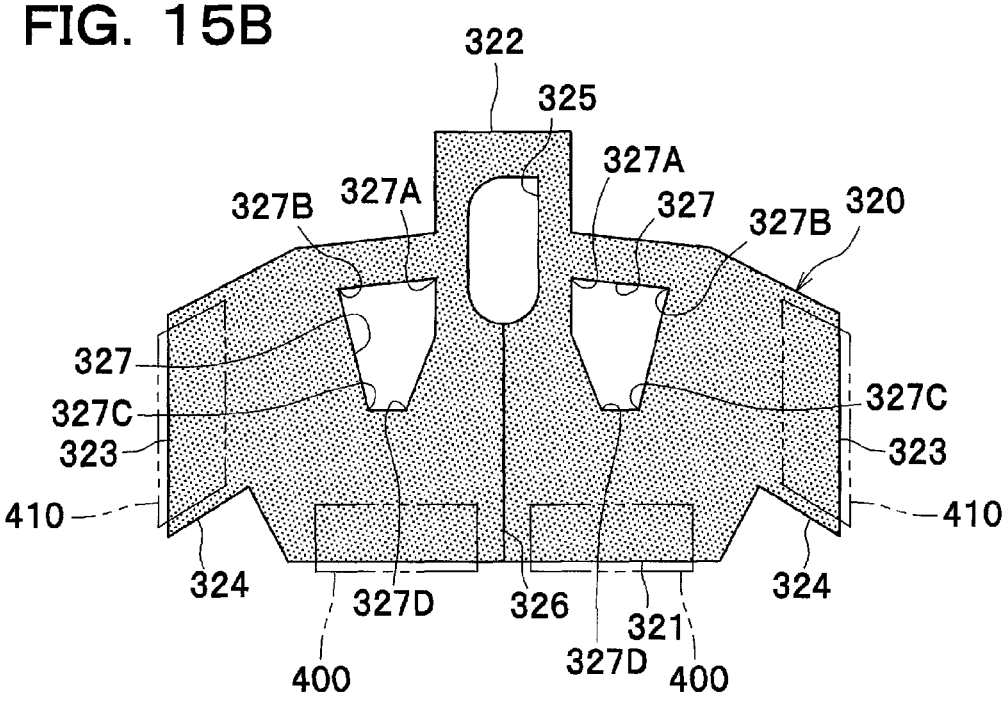
FIG. 15B is a plan view of a film.

Further, a pair of engagement holes 327 are formed in the film 320 on both sides of the slit 326 and in positions symmetrical with respect to the slit 326. As best seen in FIGS. 15A and 15B, each of the engagement holes 327 has three corners 327A, 327B, 327C corresponding to and configured to be engageable with three corners 313A, 313B, 313C of the first projection 313 of the support member 310.

The three corners 327A, 327B, 327C are formed in positions slightly rotated from the positions of the three corresponding corners 313A, 313B, 313C. To be more specific, this rotating direction is opposite to the direction where the slit 326 opens (i.e., direction where one half and the other half of the film 320 divided by the slit 326 are moved away from each other along a circular trajectory with the proximal end 322 of the film 320 being the center of rotation).

More specifically, the three corners 327A, 327B, 327C of the engagement hole 327 formed in the left half of the film 320 shown in FIG. 15B are arranged in positions rotated anticlockwise from the corresponding positions of the three corners 313A, 313B, 313C of the first projection 313 provided on the left arm portion 312 shown in FIG. 15A. On the contrary, the three corners 327A, 327B, 327C of the engagement hole 327 formed in the right half of the film 320 shown in FIG. 15B are arranged in positions rotated clockwise from the corresponding positions of the three corners 313A, 313B, 313C of the first projection 313 provided on the right arm portion 312 shown in FIG. 15A. Therefore, when mounting the film 320 on the support member 310 by inserting the first projections 313 into the corresponding engagement holes 327, the corners 327A, 327B, 327C move to the positions of and conform with the corresponding corners 313A, 313B, 313C to thereby slightly open the slit 326 as shown in FIG. 12. Namely, the slit 326 is opened due to a difference in shape of the corresponding mounting portions (i.e., the first projections 313 and the engagement holes 327) of the arm portions 312 and the film 320.

As seen in FIG. 13, the block sponge 330 is an electrically insulative contact member configured to slidably contact with the discharge wire 110 (see FIG. 2) in the extension direction. The block sponge 330 is folded into a substantially U-shaped configuration and supported on the support member 310 between the second projections 314. Since the second projections 314 nip and support the block sponge 330, the film 320 is disposed and held between the block sponge 330 and the support member 310.

Figure 16:
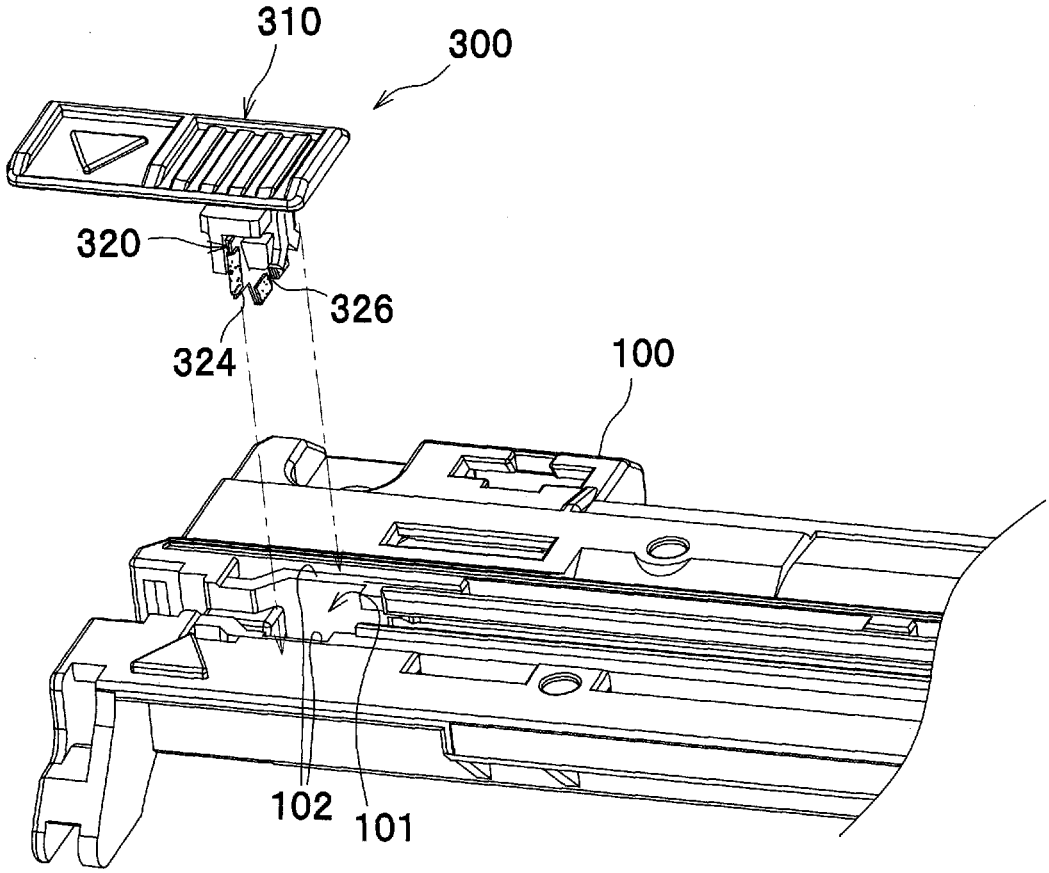
FIG. 16 is an exploded perspective view illustrating a state in which the cleaning member according to the second embodiment is being mounted to the upper frame.

As best seen in FIG. 16, a pair of engagement walls 102 are formed at one end side of the longitudinal groove 101 formed in the upper frame 100. The engagement walls 102 are configured to protrude inwardly from a pair of side walls that form the longitudinal groove 101. When mounting the cleaning member 300 into the longitudinal groove 101, the notches 324 of the film 320 are brought into contact with the corresponding engagement walls 102, so that the slit 326 of the film 320 is more widely open, allowing the discharge wire 110 to be smoothly inserted into the hole 325.

Figure 17A:
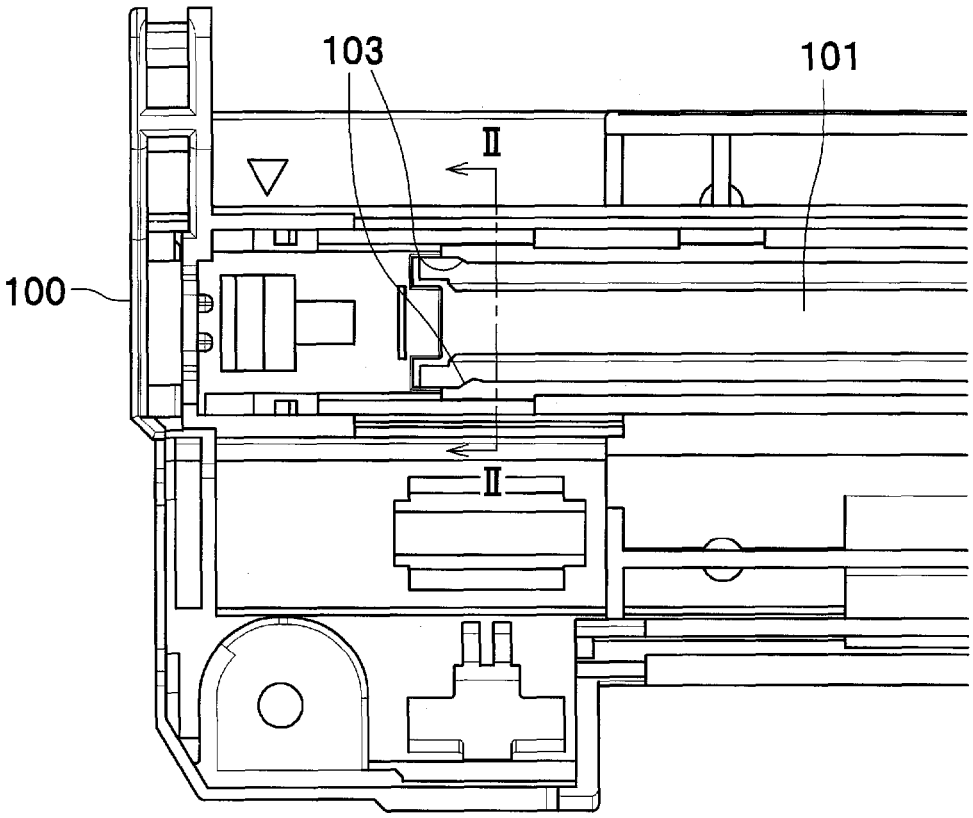
FIG. 17A is a bottom view of the upper frame as viewed from below, illustrating a state in which the discharge wire, the opposite electrode and the cleaning member are removed.
Figure 17B:
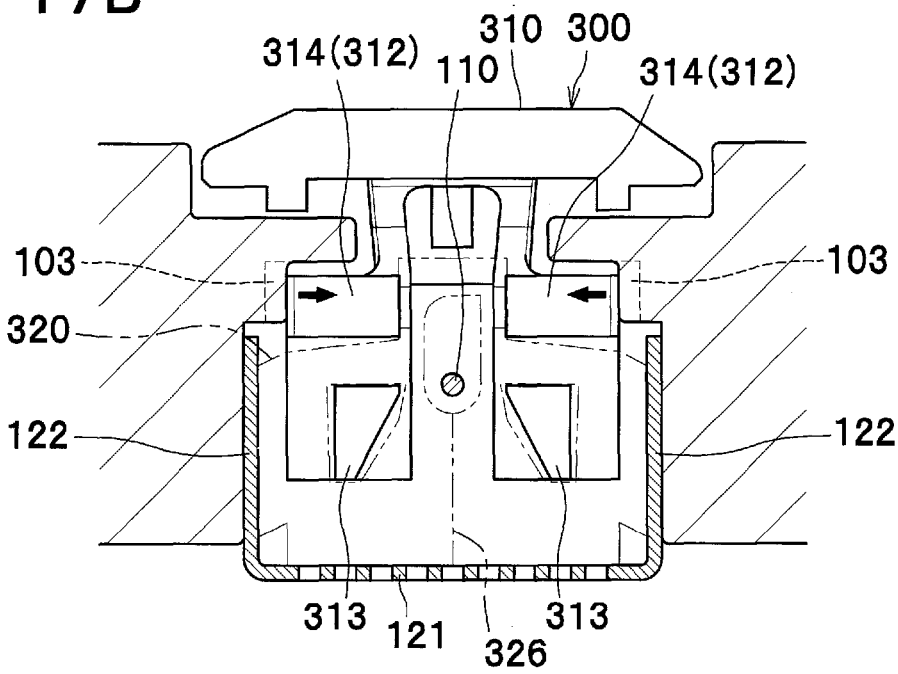
FIG. 17B is a sectional view of the upper frame taken along the line II-II of FIG. 17A, illustrating a state in which the discharge wire, the opposite electrode and the cleaning member are mounted to the upper frame.

Further, as best seen in FIGS. 17A and 17B, a pair of tapered surfaces 103 are formed in the longitudinal grove 101 of the upper frame 100, by which the arm portions 312 (more specifically, the second projections 314) of the support member 310 are urged inwardly to move toward each other. With this arrangement, when inserting the cleaning member 300 from one end side (i.e., from the engagement walls 102 side) of the longitudinal groove 101 and thereafter sliding the same toward the other side of the longitudinal groove 101, as seen in FIG. 17B, the arm portions 312 of the support member 310 are urged inwardly to move toward each other to thereby close the slit 326 of the film 320.

To be more specific, the pair of tapered surfaces 103 urge the arm portions 312 (second projections 314) to move toward each other, and thereby the two corners 313A, 313D (see FIG. 15A) integrally formed on the first projection 313 of each arm portion 312 urge the corresponding two corners 327A, 327D of each engagement hole 327 of the film 320 inwardly toward each other. This causes the slit 326 of the film 320 to be closed. Therefore, when the cleaning member 300 is in a cleaning position for cleaning the grid electrode 121, the slit 326 is closed and the film 320 slidably contacts with the whole surface of the grid electrode 121. It is thus possible to satisfactorily clean the grid electrode 121. Further, since the block sponge 330 (see FIG. 12) is compressed when the arm portions 312 of the support member 310 are urged inwardly to move toward each other, the block sponge 330 can frictionally and slidably contact with the discharge wire 110 to thereby satisfactorily clean the discharge wire 110.

Figure 18:
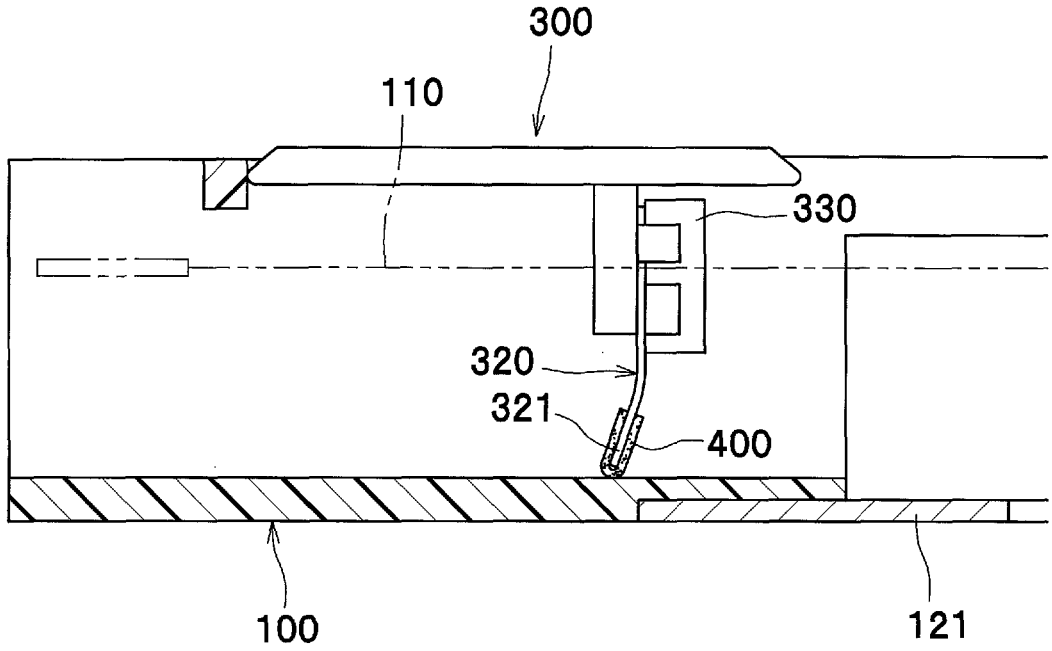
FIG. 18 is a sectional view of the cleaning member and the grid electrode at a stand-by position illustrating a relation between the cleaning member and the grid electrode.

In a stand-by position shown in FIG. 18, the abrasive member 400 is positioned away from the grid electrode 121, contacting with (placed on) the upper frame 100, so that a resinous (electrically insulative) upper frame 100 is interposed between the grid electrode 121 and the abrasive member 400. As used herein, the term "stand-by position" indicates a position at one end side of the discharge wire 110 where the cleaning member 300 stands by during the printing operation, so as not to interfere with electric discharge from the discharge wire 110 to the photoconductor drum 53. With this arrangement, in the case where the abrasive member 400 is a metal file, an electric leakage from the grid electrode 121 to the metal file can be reliably prevented.

In the case where a metal file is employed, as seen in the figure, it is preferable that the metal file (abrasive member 400) is provided only at the distal end 321 of the film 320 and that the electrically insulative block sponge 330 is interposed between the discharge wire 110 and the metal file. This is because the electrically insulative block sponge 330 can reliably prevent electric leakage from the discharge wire 110 to the metal file.

It is to be noted that the size of the metal file is preferably set such that the metal file is not interposed between the block sponge 330 and the film 320; in other words, the metal file does not reach to an area of the block sponge 330 that faces to the film 320. This is because the block sponge 330 is brought into intimate contact with the film 320 to thereby reliably hold the film 320 on the support member 310.

According to the charger 54 in the second embodiment, the following advantageous effects can be expected.

Since the folded portion 401 of the abrasive member 400 is brought into contact with the grid electrode 121, even if the grid electrode 121 contains adverse conditions such as burrs B or irregularities, the folded portion 401 can move across the burrs B and the like. Therefore, a smooth sliding movement of the cleaning member 300 can be realized, and the grid electrode 121 can be satisfactorily cleaned.

Since the abrasive member 400 is adapted as a contact member which contacts with the grid electrode 121, foreign objects (toner, etc.) adhering to the grid electrode 121 can be scraped off by the abrasive member 400. In the case where the abrasive member 400 is a film-like metal file, improved durability on the abrasive member 400 can be achieved, and this can reduce wear in the abrasive member 400 when the abrasive member 400 contacts with a burr B on the metal grid electrode 121.

Since the abrasive member 400 is strongly pressed against the grid electrode 121 by means of the flexurally deformed film 320, foreign objects (toner, etc.) adhering to the grid electrode 121 can be satisfactorily scraped off by the abrasive member 400.

Since the felt members 410 made of a porous material are provided at the both side ends 323 of the film 320, foreign objects adhering to the shield electrodes 122 can be satisfactorily scraped off by the felt members 410.

Since the block sponge 330 is disposed between the abrasive member 400 and the discharge wire 110, in the case where a metal file is employed as the abrasive member 400, it is possible to prevent electric leakage from the discharge wire 110 to the metal file.

Since the cleaning member 300 includes the block sponge 330 for cleaning the discharge wire 110 and the film 320 for cleaning the opposite electrode 120, the discharge wire 110 and the opposite electrode 120 can be cleaned simultaneously by sliding the cleaning member 300 along the extension direction of the discharge wire 110. Further, since the film 320 is disposed and held between the support member 310 and the block sponge 330, the block sponge 330 for cleaning the discharge wire 110 can also function as a disengagement preventing member for the film 320, which prevents the film 320 from being disengaged from the support member 310. This reduces the number of constituent parts.

Since at the stand-by position of the cleaning member 300, the abrasive member 400 is positioned away from the grid electrode 121 and comes in contact with the upper frame 100, in the case where the abrasive member 400 is a metal file, an electric leakage from the grid electrode 121 to the metal file can be reliably prevented.

Since the notches 324 are formed in the film 320 between the distal end 321 and the both side ends 323, the distal end 321 and the both side ends 323 of the film 320 are free from each other from deformation caused by flexing the film 320. Therefore, it is possible for the distal end 321 and the both side ends 323 of the film 320 to contact with the grid electrode 121 and the shield electrodes 122 with a high degree of accuracy.

The cleaning member 300 is configured such that when the film 320 is mounted to the support member 310, the slit 326 is open due to a difference in shape of corresponding mounting portions of the arm portions 312 and the film 320. This allows the discharge wire 110 to be smoothly inserted and set into the hole 325 through the open slit 326, thereby simplifying the attachment of the cleaning member 300 to the upper frame 100.

When mounting the cleaning member 300 to the upper frame 100, the notches 324 (at the both side ends) of the film 320 are brought into contact with the upper frame 100, so that the slit 326 is more widely open. This allows the discharge wire 110 to be more smoothly inserted and set into the hole 325 through this widely open slit 326, thereby furthermore simplifying the attachment of the cleaning member 300.

The pair of tapered surfaces 103 of the upper frame 100 urge the arm portions 312 of the support member 310 to move toward each other, so that the open slit 326 is closed. Therefore, the distal end 321 of the film 320 is caused to slidably contact with the grid electrode 121 in a preferable manner.

Although the present invention has been described in detail with reference to the above second embodiment, the present invention is not limited to this specific embodiment and various changes and modifications as described below may be made without departing from the scope of the appended claims.

In the second embodiment as described above, the film 320 as an example of a sheet-like member is made of polyethylene terephthalate (PET). However, the present invention is not limited to this specific embodiment. For example, the film 320 may be made of other resin films or paper. Further, the sheet-like member may be a non-flexible member.

In the second embodiment as described above, the film-like abrasive member 400 is wound at the distal end 321 of the film 320. However, the present invention is not limited to this specific embodiment. For example, a member which provides little abrasive force may be wound at the distal end 321 of the film 320. In this arrangement, too, since the member is readily movable across burrs, a smooth sliding operation of the cleaning member can be realized.

In the second embodiment as described above, the felt member 410 is employed as a wipe-off member made of a porous material. However, the present invention is not limited to this specific embodiment. For example, a sponge or the like may be used as the wipe-off member.

In the second embodiment as described above, the film 320 slidably contacts with the grid electrode 121 and the shield electrodes 122 (specifically, at the abrasive member 400 and the felt members 410). However, the present invention is not limited to this specific embodiment. For example, the film 320 may slidably contact with the grid electrode 121 only.

In the second embodiment as described above, the film 320 is configured such that the notches 324 are brought into contact with the corresponding engagement walls 102 of the upper frame 100. However, the present invention is not limited to this specific embodiment. For example, the notches may be formed so as not to contact with the engagement walls 102. In this arrangement, too, when the first projections 313 of the support member 310 are inserted into the corresponding engagement holes 327 of the film 320, the slit 326 can be opened. Therefore, the discharge wire 110 can be inserted into the hole 325 through this open slit 326.

In the second embodiment as described above, the notch 324 is formed as a V-shaped recess. However, the notch may be formed as a slit.

In the second embodiment as described above, the block sponge 330 is employed as a contact member. However, as an alternative, a felt block may be employed.

In the second embodiment as described above, the present invention is adapted to the color printer 1. However, the present invention may be adapted to other image forming apparatuses, such as a copying machine and a multifunction device.

In the second embodiment as described above, the photoconductor drum 53 is employed as a photoconductor. However, as an alternative, a belt-type photoconductor may be employed.

Third Embodiment

A charger according to the third embodiment will be described below.

Figure 19:
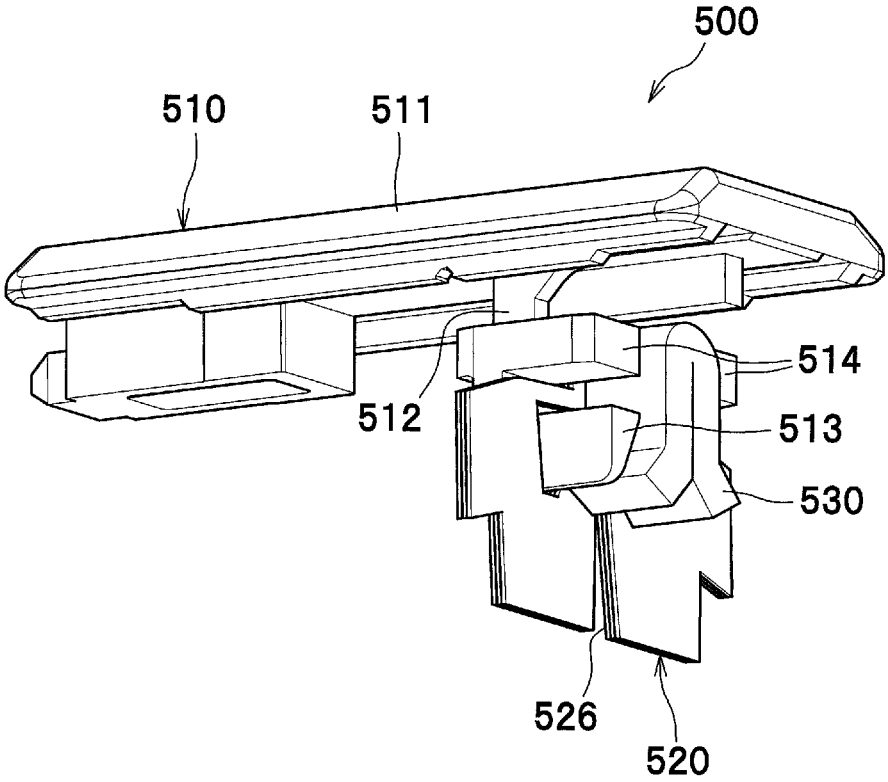
FIG. 19 is a perspective view illustrating a cleaning member according to a third embodiment.

A charger 54 according to the third embodiment comprises the upper frame 100 (electrically insulative), the discharge wire 110 and the opposite electrode 120, which are substantially identical with those of the first and second embodiments, and a cleaning member 500 shown in FIG. 19.

As seen in FIG. 3, the cleaning member 500 is slidably mounted in the longitudinal groove 101 of the upper frame 100, so that the cleaning member 500 is movable in the extension direction of the discharge wire 110. The cleaning member 500 is configured to reciprocate along the extension direction, and a moving direction of the cleaning member 500 is switchable between a first direction and a second direction opposite to the first direction. The cleaning member 500 moves in the longitudinal groove 101 while slidably contacting with the discharge wire 110 and the opposite electrode 120 (see FIG. 2), so as to clean the discharge wire 110 and the opposite electrode 120. To be more specific, as best seen in FIG. 19, the cleaning member 500 comprises a support member 510, a sheet-like member 520, and a block sponge 530 as an example of a contact member.

Figure 20:
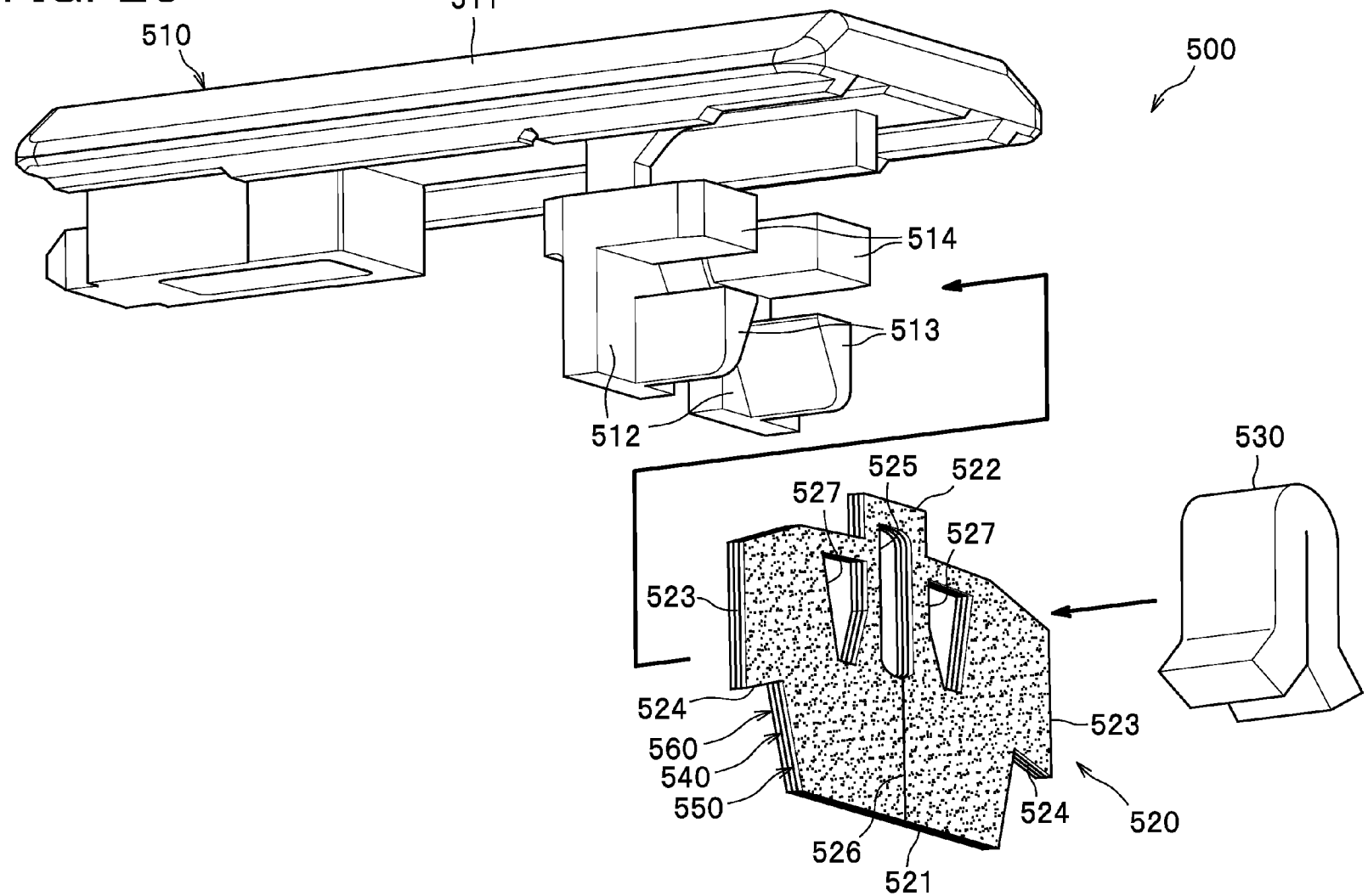
FIG. 20 is an exploded perspective view illustrating the cleaning member according to the third embodiment.

As seen in FIG. 20, the support member 510 mainly includes a manipulation portion 511 in the form of a substantially rectangular flat plate, and two flexible arm portions 512 extending downwardly from a lower surface of the manipulation portion 511. Each arm portion 512 has a first projection 513 and a second projection 514, for the purpose of supporting the sheet-like member 520 and the block sponge 530.

The first projection 513 is in the form of a substantially triangular prism. The first projection 513 protrudes through an engagement hole 527 formed in the sheet-like member 520, and supports the sheet-like member 520. To be more specific, each of the first projections 513 supports one of or the other one of halves of the sheet-like member 520 divided by a slit 526 to be described later. The first projections 513 function to hold the block sponge 530 that is folded into a substantially U-shaped configuration and to prevent both ends of the folded block sponge 530 from being spread open in a direction away from each other.

The second projection 514 is in the form of a quadrangular prism. The second projections 514 nip and support a folded-back portion of the substantially U-shaped block sponge 530.

As seen in FIG. 20, the sheet-like member 520 contacts with the opposite electrode 120 and is made of a deformable material. The sheet-like member 520 has different roughness at front and reverse surfaces. The sheet-like member 520 is configured such that when switching the moving direction of the cleaning member 500, that portion of the sheet-like member 520 which contacts with the opposite electrode 120 is turned upside down (i.e., switched) between the front surface and the reverse surface, due to friction against the opposite electrode 120 and/or an engagement with an engagement portion 108 (see FIG. 22) to be described later.

To be more specific, the sheet-like member 520 is formed by laminating a film 540 made of a deformable material such as polyethylene terephthalate (PET), an abrasive member 550 as an example of a first member, and a felt member 560 as an example of a second member (wipe-off member) made of a different material from that of the first member. The sheet-like member 520 is supported by the support member 510 in a substantially perpendicular position relative to the grid electrode 121 and the shield electrodes 122.

The film 540 has a surface to which the abrasive member 550 is fixed, and a reverse surface to which the felt member 560 is fixed. Because of this flexurally deformable film 540, the abrasive member 550 and the felt member 560 at the front and reverse surfaces of the film 540 can be pressed against the opposite electrode 120 at a desired pressure.

Although the abrasive member 550 and the felt member 560 surface contact with the opposite electrode 120 (see FIGS. 22A to 22C), the present invention is not limited to this specific embodiment. It is also possible that the abrasive member 550 and the felt member 560 contact with the opposite electrode 120 at their corners.

The abrasive member 550 is a member for constituting the surface of the sheet-like member 520, and is made of an abrasive material having a surface sufficient for scraping off objects adhering to the opposite electrode, such as a film-like metal file or a sand paper. Therefore, toner adhering to the grid electrode 121 can be scraped off by means of the abrasive member 550.

The felt member 560 is a member for constituting the reverse surface of the sheet-like member 520. The felt member 560 is made of a porous material softer than the abrasive member 550 and having a surface roughness smaller than that of the abrasive member 550. Therefore, debris generated by scraping off the grid electrode 121 by means of the abrasive member 550 and foreign objects adhering to the grid electrode 121 can be satisfactorily wiped off by the felt member 560.

The film 540, the abrasive member 550, and the felt member 560 have substantially the same shape and dimensions. To be more specific, a sheet-like member is formed by laminating and bonding these three members, followed by stamping into a sheet-like member 520. Therefore, the sheet-like member 520 having a shape such as shown in the figures can be simply manufactured.

The thus obtained three-layer sheet-like member 520 has a distal end 521 as a first end portion at which the sheet-like member 520 contacts with the grid electrode 121 (see FIG. 2), a proximal end 522 which is positioned opposite to the distal end 521, and a pair of side ends 523 as a pair of second end portions, arranged at both sides of the distal end 521 in a direction transverse to the distal end 521 and configured to contact with the pair of shield electrodes 122 (see FIG. 2).

A notch 524 is formed in the sheet-like member 520 between the distal end 521 and each of the side ends 523. The provision of the notches 524 at both side ends 523 is advantageous because the distal end 521 and the both side ends 523 are free from each other from deformation caused by flexing the sheet-like member 520 and thus allows the distal end 521 and the both side ends 523 of the sheet-like member 520 to contact with the grid electrode 121 and the shield electrodes 122 with a high degree of accuracy.

A hole 525 for inserting the discharge wire 110 (see FIG. 2) is formed in the sheet-like member 520, and a slit 526 is formed in the sheet-like member 520 which extends from the hole 525 and reaches to the distal end 521. The hole 525 is formed so as not to be symmetrical with respect to the slit 526. This is to avoid a wrong assembly of the sheet-like member 520 that may occur when assembling the sheet-like member 520 upside down. Therefore, even if the sheet-like member 520 is visibly checked and assembled, an accurate assembly of the sheet-like member 520 can be performed while avoiding the sheet-like member 520 being placed on burrs that are formed around the hole 525 and the like on the reverse surface of the sheet-like member 520.

In place of changing the shape of the hole 525, it is also possible to avoid a wrong assembly by changing shapes of the left-side first projection 513 and the right-side first projection 513, and further by changing shapes of engagement holes 527 to be described later in accordance with the shapes of these first projections 513. Dedicated structure for preventing a wrong assembly may be provided; for example, the support member 510 has a projection at one side with respect to the slit 526, and the sheet-like member 520 has a corresponding hole into which the projection is inserted.

Figure 21A:
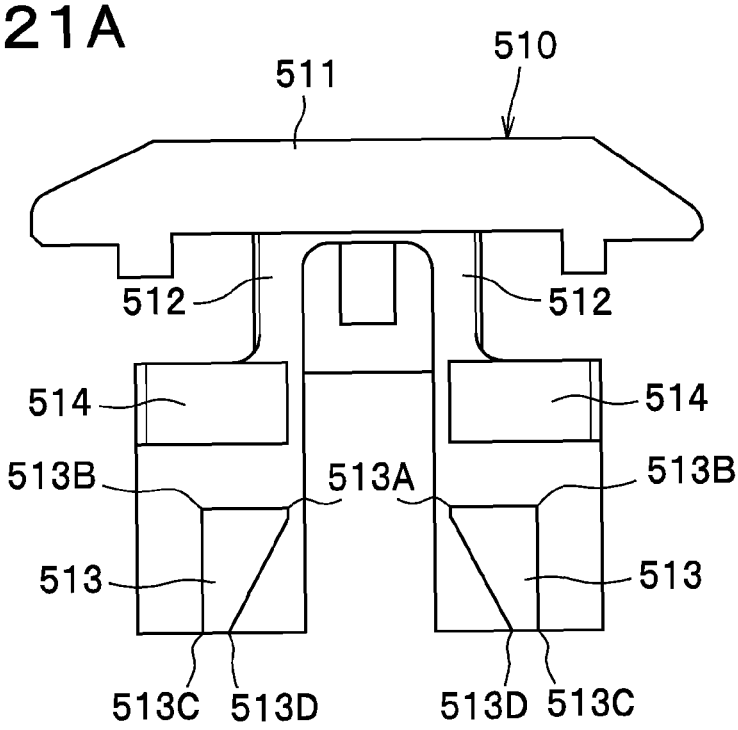
FIG. 21A is a front view of a support member as viewed from a front side of first projections.
Figure 21B:
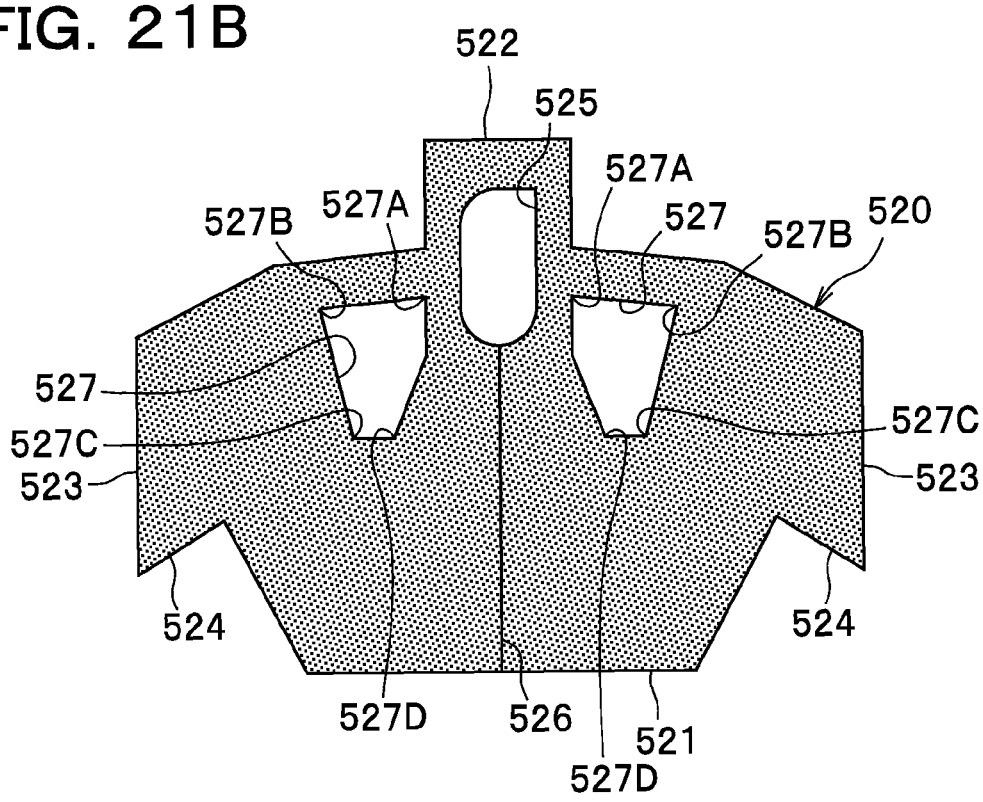
FIG. 21B is a plan view of a sheet-like member.

Further, a pair of engagement holes 527 are formed in the sheet-like member 520 on both sides of the slit 526 and in positions symmetrical with respect to the slit 526. As best seen in FIGS. 21A and 21B, each of the engagement holes 527 has three corners 527A, 527B, 527C corresponding to and configured to be engageable with three corners 513A, 513B, 513C of the first projection 513 of the support member 510.

The three corners 527A, 527B, 527C are formed in positions slightly rotated from the positions of the three corresponding corners 513A, 513B, 513C. To be more specific, this rotating direction is opposite to the direction where the slit 526 opens (i.e., direction where one half and the other half of the sheet-like member 520 divided by the slit 526 are moved away from each other along a circular trajectory with the proximal end 522 of the sheet-like member 520 being the center of rotation).

More specifically, the three corners 527A, 527B, 527C of the engagement hole 527 formed in the left half of the sheet-like member 520 shown in FIG. 21B are arranged in positions rotated anticlockwise from the corresponding positions of the three corners 513A, 513B, 513C of the first projection 513 provided on the left arm portion 512 shown in FIG. 21A. On the contrary, the three corners 527A, 527B, 527C of the engagement hole 527 formed in the right half of the sheet-like member 520 shown in FIG. 21B are arranged in positions rotated clockwise from the corresponding positions of the three corners 513A, 513B, 513C of the first projection 513 provided on the right arm portion 512 shown in FIG. 21A.

Therefore, when mounting the sheet-like member 520 on the support member 510 by inserting the first projections 513 into the corresponding engagement holes 527, the corners 527A, 527B, 527C move to the positions of and conform with the corresponding corners 513A, 513B, 513C to thereby slightly open the slit 526 as shown in FIG. 19. Namely, the slit 526 is opened due to a difference in shape of the corresponding mounting portions (i.e., the first projections 513 and the engagement holes 527) of the arm portions 512 and the sheet-like member 520.

As seen in FIG. 20, the block sponge 530 is an electrically insulative contact member configured to slidably contact with the discharge wire 110 (see FIG. 2) in the extension direction.

The block sponge 530 is folded into a substantially U-shaped configuration and supported on the support member 510 between the second projections 514. Since the second projections 514 nip and support the block sponge 530, the sheet-like member 520 is disposed and held between the block sponge 530 and the support member 510.

Figure 22A:
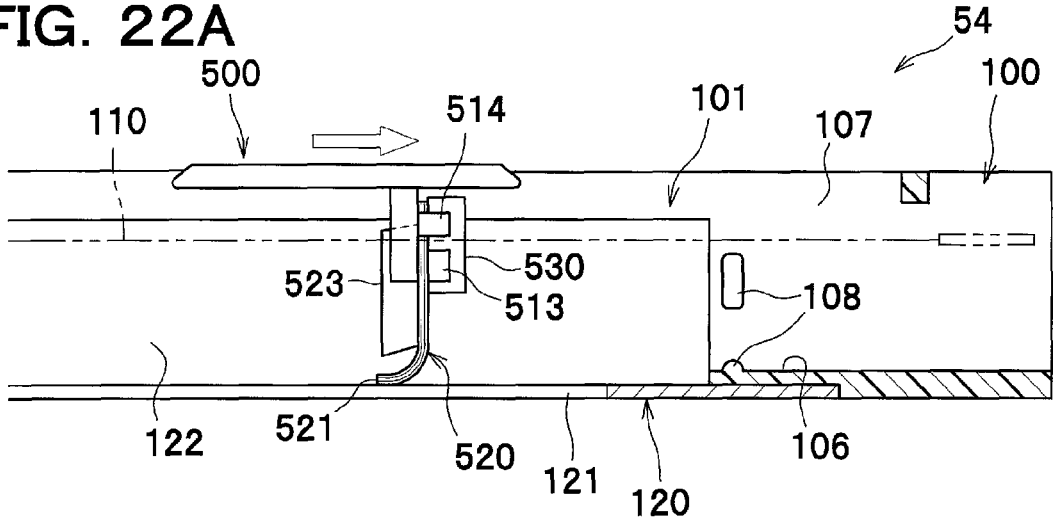
FIG. 22A is a sectional view illustrating a state in which the cleaning member according to the third embodiment is being moved in one direction.

Further, as best seen in FIG. 22A, plural pairs of inwardly protruding engagement portions 108 are provided at both end portions of the opposite electrode 120 as viewed in the extension direction, that is, on the bottom surface 106 and both side surfaces 107 (only one side surface is shown in the figure) at both end portions of the longitudinal groove 101 formed in the upper frame 100. With this arrangement, as seen in FIGS. 22B and 22C, when changing the moving direction of the cleaning member 500 after the sheet-like member 520 moves across the engagement portions 108, the distal end 521 and the both side ends 523 of the sheet-like member 520 come into engagement with the corresponding engagement portions 108, so that the distal end 521 and the both side ends 523 are reliably switched between the front and reverse surfaces.

Figure 22B:
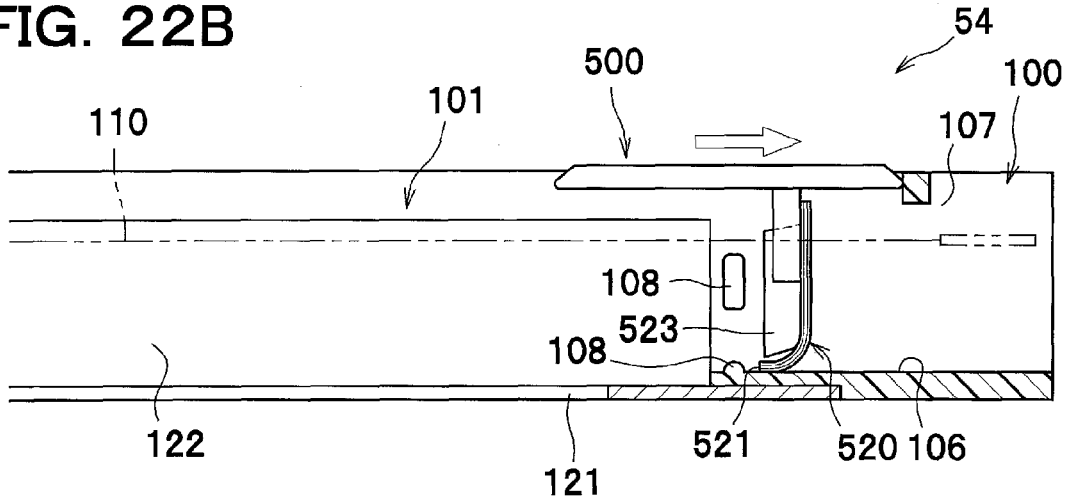
FIG. 22B is a sectional view illustrating a state in which the sheet-like member is being moved across an engagement portion.
Figure 22C:
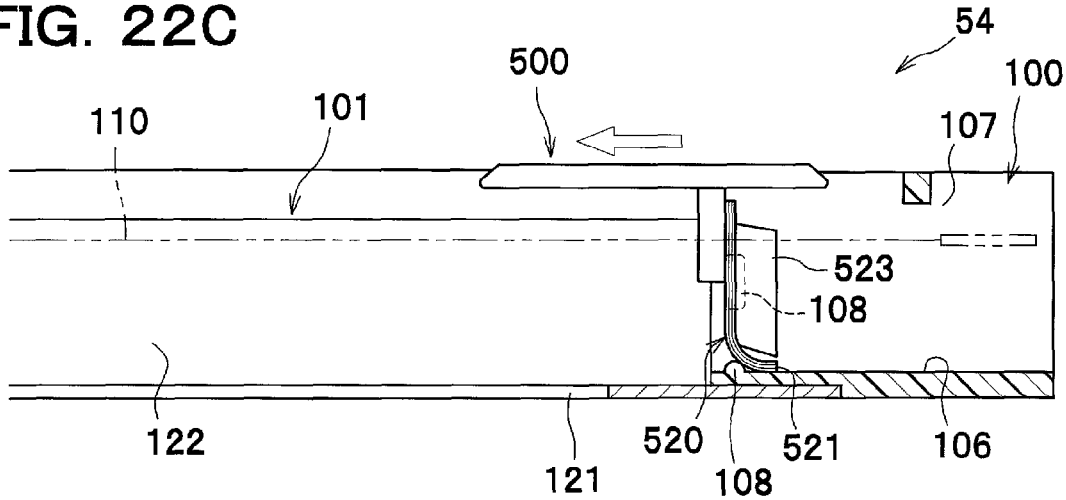
FIG. 22C is a sectional view illustrating a state in which a part of the sheet-like member is turned upside down by the engagement portion.

For better understanding the relation between the both side ends 523 and the engagement portions 108, in FIGS. 22B and 22C, the first projection 513, the second projection 514, and the block sponge 530 show in FIG. 22A are omitted from the figures.

Figure 23:
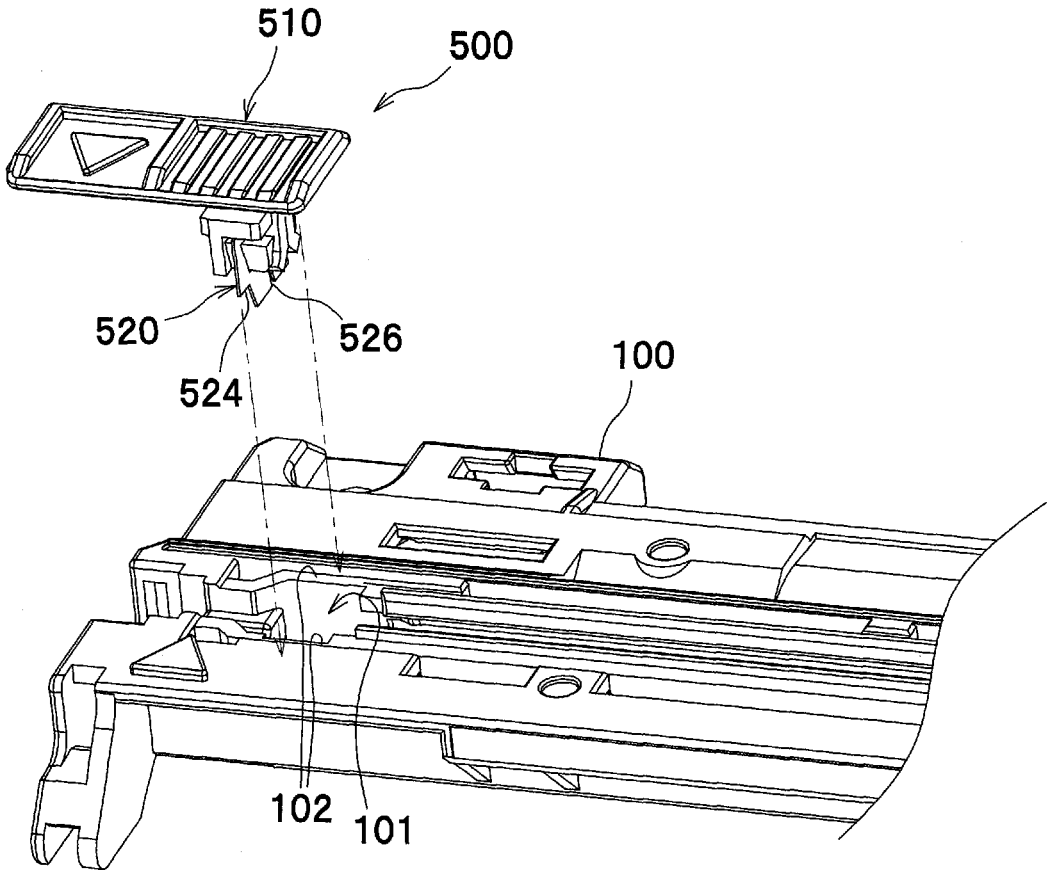
FIG. 23 is an exploded perspective view illustrating a state in which the cleaning member according to the third embodiment is being mounted to the upper frame.

As best seen in FIG. 23, a pair of engagement walls 102 are formed at one end side of the longitudinal groove 101 formed in the upper frame 100. The engagement walls 102 are configured to protrude inwardly from a pair of side walls that form the longitudinal groove 101. When mounting the cleaning member 500 into the longitudinal groove 101, the notches 524 (at both side end) of the sheet-like member 520 are brought into contact with the corresponding engagement walls 102, so that the slit 526 of the sheet-like member 520 is more widely open, allowing the discharge wire 110 to be smoothly inserted into the hole 525.

Figure 24A:
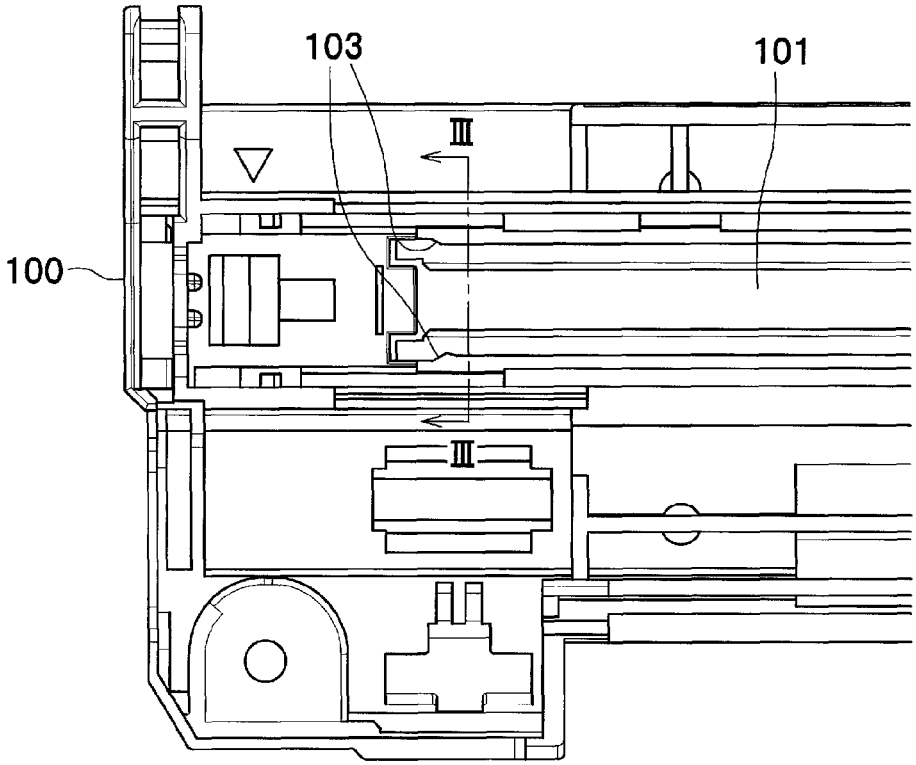
FIG. 24A is a bottom view of the upper frame as viewed from below, illustrating a state in which the discharge wire, the opposite electrode and the cleaning member are removed.
Figure 24B:
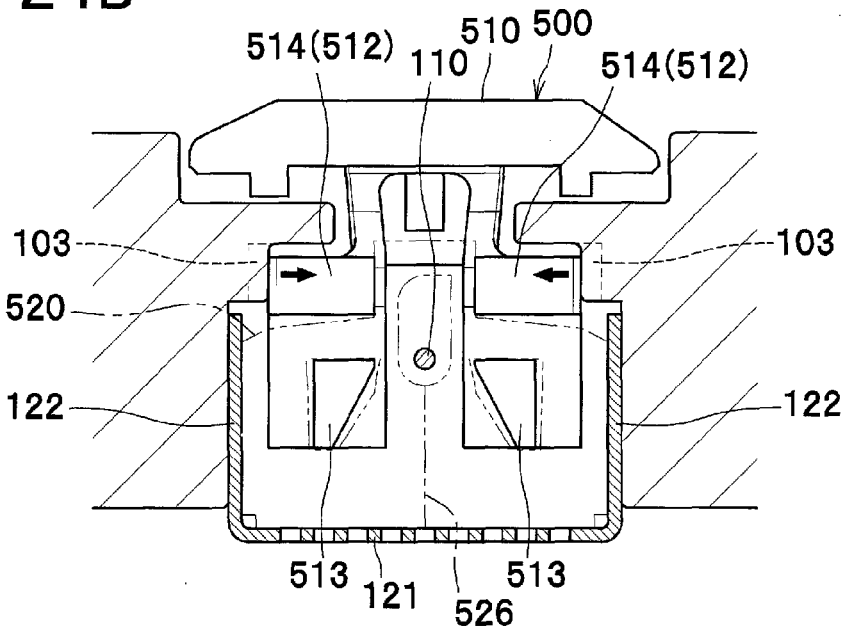
FIG. 24B is a sectional view of the upper frame taken along the line III-III of FIG. 24A, illustrating a state in which the discharge wire, the opposite electrode and the cleaning member are mounted to the upper frame.

Further, as best seen in FIGS. 24A and 24B, a pair of tapered surfaces 103 are formed in the longitudinal grove 101 of the upper frame 100, by which the arm portions 512 (more specifically, the second projections 514) of the support member 510 are urged inwardly to move toward each other. With this arrangement, when inserting the cleaning member 500 from one end side (i.e., from the engagement walls 102 side) of the longitudinal groove 101 and thereafter sliding the same toward the other side of the longitudinal groove 101, as seen in FIG. 24B, the arm portions 512 of the support member 510 are urged inwardly to move toward each other to thereby close the slit 526 of the sheet-like member 520.

To be more specific, the pair of tapered surfaces 103 urge the arm portions 512 (second projections 514) to move toward each other, and thereby the two corners 513A, 513D (see FIG. 21A) integrally formed on the first projection 513 of each arm portion 512 urge the corresponding two corners 527A, 527D of each engagement hole 527 of the sheet-like member 520 inwardly toward each other. This causes the slit 526 of the sheet-like member 520 to be closed. Therefore, when the cleaning member 500 is in a cleaning position for cleaning the grid electrode 121, the slit 526 is closed and the sheet-like member 520 slidably contacts with the whole surface of the grid electrode 121. It is thus possible to satisfactorily clean the grid electrode 121. Further, since the block sponge 530 (see FIG. 19) is compressed when the arm portions 512 of the support member 510 are urged inwardly to move toward each other, the block sponge 530 can frictionally and slidably contact with the discharge wire 110 to thereby satisfactorily clean the discharge wire 110.

According to the charger 54 in the third embodiment, the following advantageous effects can be expected.

Since the sheet-like member 520 having different roughness at the front and reverse surfaces is turned upside down at a portion of the sheet-like member 520 which contacts with the opposite electrode 120 whenever the moving direction of the cleaning member 500 is switched over, the cleaning conditions can be changed between the first passage and the second passage for the cleaning member 500. Particularly, in this embodiment, toner and the like adhering to the opposite electrode 120 can be scraped off in the first passage by means of the abrasive member 550 which constitutes a rough surface, and the scraped toner and the like can be removed in the second passage by means of the felt member 560 which constitutes a smooth surface. Thereby, the opposite electrode 120 can be cleaned in a preferable manner.

Since the sheet-like member 520 can be formed by simply laminating a plurality of members made of different materials, the manufacturing operation for the sheet-like member 520 can be simplified.

Since the sheet-like member 520 is provided with the abrasive member 550, and the felt member 560 which is porous and softer than the abrasive member 550, a scrape-off effect and a wipe-off effect can be satisfactorily realized.

The engagement portions 108 are provided at both end portions of the opposite electrode 120, as viewed in the extension direction, and end portions of the sheet-like member 520 are engaged with the engagement portions 108 to turn the sheet-like member 520 upside down at a portion which contacts with the opposite electrode 120. Therefore, it is possible to perform a reliable switching between the front surface and the reverse surface.

Since the sheet-like member 520 is configured such that the distal end 521 contacts with the grid electrode 121 and the both side ends 523 contact with the shield electrodes 122, the grid electrode 121 and the shield electrodes 122 can be satisfactorily cleaned simultaneously.

Since the notches 524 are formed in the sheet-like member 520 between the distal end 521 and the both side ends 523, the distal end 521 and the both side ends 523 of the sheet-like member 520 are free from each other from deformation caused by flexing the sheet-like member 520. Therefore, it is possible for the distal end 521 and the both side ends 523 of the sheet-like member 520 to contact with the grid electrode 121 and the shield electrodes 122 with a high degree of accuracy. Further, the distal end 521 and the both side ends 523 of the sheet-like member 520 can be reliably switched between the front and reverse surfaces.

Since the cleaning member 500 includes the block sponge 530 for cleaning the discharge wire 110 and the sheet-like member 520 for cleaning the opposite electrode 120, the discharge wire 110 and the opposite electrode 120 can be cleaned simultaneously by sliding the cleaning member 500 along the extension direction of the discharge wire 110. Further, since the sheet-like member 520 is disposed and held between the support member 510 and the block sponge 530, the block sponge 530 for cleaning the discharge wire 110 can also function as a disengagement preventing member for the sheet-like member 520, which prevents the sheet-like member 520 from being disengaged from the support member 510. This reduces the number of constituent parts.

The cleaning member 500 is configured such that when the sheet-like member 520 is mounted to the support member 510, the slit 526 is open due to a difference in shape of corresponding mounting portions of the arm portions 512 and the sheet-like member 520. This allows the discharge wire 110 to be smoothly inserted and set into the hole 525 through the open slit 526, thereby simplifying the attachment of the cleaning member 500 to the upper frame 100.

When mounting the cleaning member 500 to the upper frame 100, the notches 524 (at the both side ends) of the sheet-like member 520 are brought into contact with the upper frame 100, so that the slit 526 is more widely open. This allows the discharge wire 110 to be more smoothly inserted and set into the hole 525 through this widely open slit 526, thereby furthermore simplifying the attachment of the cleaning member 500.

The pair of tapered surfaces 103 of the upper frame 100 urge the arm portions 512 of the support member 510 to move toward each other, so that the open slit 526 is closed. Therefore, the distal end 521 of the sheet-like member 520 slidably contacts with the grid electrode 121 in a preferable manner.

Since the sheet-like member 520 is supported by the support member 510 in a substantially perpendicular position relative to the grid electrode 121 and the shield electrodes 122, whenever the moving direction of the cleaning member 500 is switched to the other direction, the sheet-like member 520 can be switched between the front and reverse surfaces in a reliable manner.

Although the present invention has been described in detail with reference to the above third embodiment, the present invention is not limited to this specific embodiment and various changes and modifications as described below may be made without departing from the scope of the appended claims.

In the third embodiment as described above, the abrasive member 550 slidably contacts with the shield electrodes 122. However, the present invention is not limited to this specific embodiment. For example, the abrasive member 550 in the third embodiment may be cut at regions contacting with the shield electrodes 122, so that the film 540 slidably contacts with the shield electrodes 122. This is advantageous because the size of the abrasive member 550 is reduced, which leads to reduction in the cost. Even with this arrangement in which the abrasive member 550 is cut at regions contacting with the shield electrodes 122, the shield electrodes 122 can be cleaned with satisfaction. This is because few toner adheres to the shield electrodes 122 which are distanced away from the photoconductor than the distance between the grid electrode 121 and the photoconductor.

Figure 25:
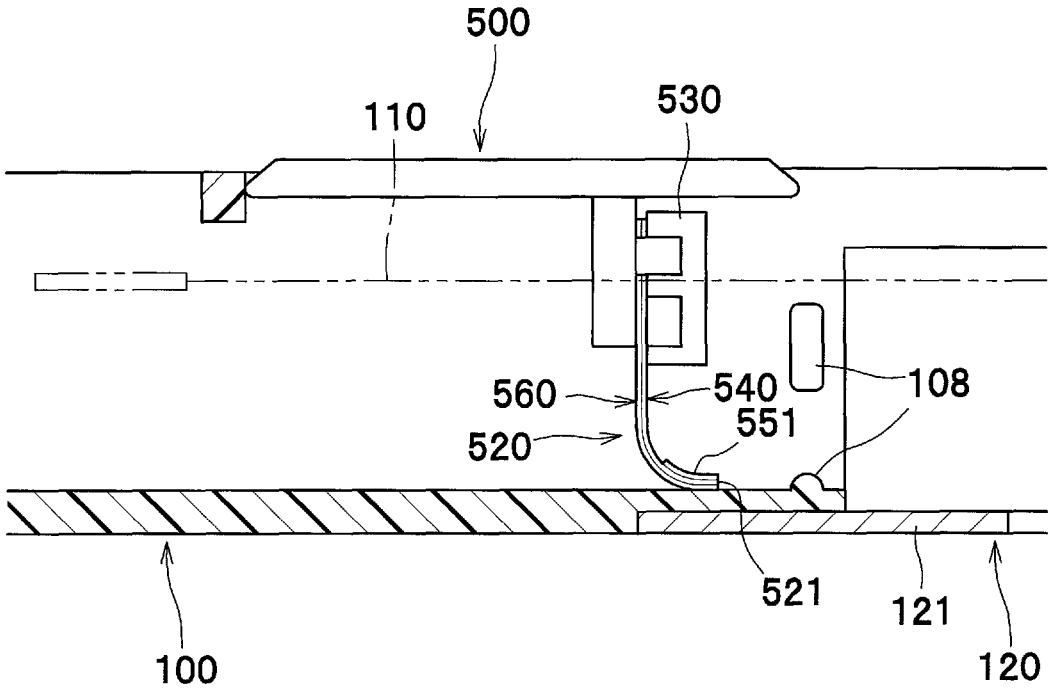
FIG. 25 is a sectional view illustrating a metal file used as an abrasive member.

In the case where a film-like metal file is employed as the abrasive member 550, as seen in FIG. 25, it is preferable that a metal file 551 is provided only at the distal end 521 of the sheet-like member 520 and that the electrically insulative block sponge 530 is interposed between the discharge wire 110 and the metal file 551. This is because the electrically insulative block sponge 530 can reliably prevent electric leakage from the discharge wire 110 to the metal file 551.

It is to be noted that the size of the metal file 551 is preferably set such that the metal file 551 is not interposed between the block sponge 530 and the film 540; in other words, the metal file does not reach to an area of the block sponge 530 that faces to the film 540. This is because the block sponge 530 is brought into intimate contact with the film 540 to thereby reliably hold the film 540 on the support member 510.

In a stand-by position shown in FIG. 25, the metal file 551 is preferably positioned away from the grid electrode 121, contacting with (placed on) the upper frame 100, so that a resinous (electrically insulative) upper frame 100 is interposed between the grid electrode 121 and the metal file 551. As used herein, the term "stand-by position" indicates a position at one end side of the discharge wire 110 where the cleaning member 500 stands by during the printing operation, so as not to interfere with electric discharge from the discharge wire 110 to the photoconductor drum 53. With this arrangement, an electric leakage from the grid electrode 121 to the metal file 551 can be reliably prevented.

In the third embodiment as described above, the sheet-like member 520 can also be switched between the front and reverse surfaces due to frictional contact against the opposite electrode 120, so that at any position of the opposite electrode 120 the switching between the front and reverse surfaces can be performed. However, the present invention is not limited to this specific embodiment. Namely, the contacting portion of the sheet-like member 520 may be turned upside down between the front and reverse surfaces at least at both end portions of the discharge wire 110, as viewed in the extension direction; the sheet-like member 520 may slip on the surface of the opposite electrode, so that reversing of the sheet-like member 520 will not take place except at the both end portions of the discharge wire 110.

In the third embodiment as described above, the sheet-like member 520 has different roughness at the front and reverse surfaces by laminating three different members. However, the present invention is not limited to this specific embodiment. For example, one member (material) may have different surface roughness at the front and reverse surfaces. Alternatively, two members or four or more members may be laminated to provide different surface roughness at the front and reverse surfaces of the sheet-like member.

In the third embodiment as described above, the felt member 560 is employed as a second member (wipe-off member) made of a porous material. However, the present invention is not limited to this specific embodiment. For example, a sponge or the like may be used as the wipe-off member. Further, as long as it is made of a different material from that of the first member, the second member may not be made of a porous material. For example, the second member may be made of polyethylene terephthalate (PET). In this arrangement, too, foreign objects that have been scraped off, for example, by the first member can be collected. Therefore, a cleaning operation is performed with satisfaction.

In the third embodiment as described above, the sheet-like member 520 slidably contacts with the grid electrode 121 and the shield electrodes 122. However, the present invention is not limited to this specific embodiment. For example, the sheet-like member 520 may slidably contact with either one of the grid electrode 121 and the shield electrodes 122.

In the third embodiment as described above, the engagement portion 108 engageable with the distal end 521 of the sheet-like member 520 is provided as an upwardly protruding projection. However, the present invention is not limited to this specific embodiment. For example, the engagement portion may be formed as an obliquely upwardly protruding projection or as a recess, which allows the distal end 521 of the sheet-like member 520 to be guided smoothly. Further, instead of providing the engagement portion 108 on the upper frame 100, an engagement portion may be provided on the opposite electrode 120 by cutting and raising a part of the opposite electrode 120 or by forming a stepped portion on the opposite electrode 120.

In the third embodiment as described above, the sheet-like member 520 is configured such that the notches 524 are brought into contact with the corresponding engagement walls 102 of the upper frame 100. However, the present invention is not limited to this specific embodiment. For example, the notches may be formed so as not to contact with the engagement walls 102. In this arrangement, too, when the first projections 513 of the support member 510 are inserted into the corresponding engagement holes 527 of the sheet-like member 520, the slit 526 can be opened. Therefore, the discharge wire 110 can be inserted into the hole 525 through this open slit 526.

In the third embodiment as described above, the film 540 made of polyethylene terephthalate (PET) is used as a base to provide the flexurally deformable sheet-like member 520. However, the present invention is not limited to this specific embodiment. For example, the film 540 may be made of other resin films or paper.

In the third embodiment as described above, the notch 524 is formed as a V-shaped recess. However, the notch may be formed as a slit.

In the third embodiment as described above, the block sponge 530 is employed as a contact member. However, as an alternative, a felt block may be employed.

In the third embodiment as described above, the present invention is adapted to the color printer 1. However, the present invention may be adapted to other image forming apparatuses, such as a copying machine and a multifunction device.

In the third embodiment as described above, the photoconductor drum 53 is employed as a photoconductor. However, as an alternative, a belt-type photoconductor may be employed.

What is claimed is:

1. A charger comprising:

a discharge wire extending in a predetermined extension direction;

an opposite electrode extending in the extension direction along which the discharge wire extends and facing to the discharge wire;

a frame configured to support the discharge wire and the opposite electrode; and a cleaning member configured to move in the extension direction while slidably contacting with the opposite electrode so as to clean the opposite electrode;

wherein the cleaning member comprises:

a sheet member contacting with the opposite electrode; and a support member configured to support the sheet member, wherein the sheet member includes a distal end at which the sheet member contacts with the opposite electrode, and a proximal end at an opposite end of the distal end, and wherein the support member supports the sheet member obliquely relative to the opposite electrode such that the distal end and the proximal end of the sheet member are arranged in different positions with respect to the extension direction, and wherein the sheet member is configured to be flexible, and is supported in a curved state such that a center portion of the sheet member protrudes in the extension direction relative to both side ends of the sheet member.

2. The charger according to claim 1, wherein the support member has a recess portion by which the sheet member is supported in a curved state.

3. The charger according to claim 1, wherein the opposite electrode comprises:

a grid electrode disposed between a photoconductor and the discharge wire, the photoconductor being configured to be movable and to carry an electrostatic latent image on a surface thereof; and a pair of shield electrodes disposed along a moving direction of the photoconductor with the discharge wire interposed therebetween, wherein both side ends of the sheet member are arranged in a direction orthogonal to a direction connecting the distal end and the proximal end, and wherein the sheet member is configured to curve when the distal end contacts with the grid electrode and the pair of side ends frictionally contact with the shield electrodes.

4. The charger according to claim 3, wherein a notch is formed in the sheet member between the distal end and each of the side ends.

5. The charger according to claim 4, wherein the cleaning member further comprises a contact member configured to be supported by the support member and to slidably contact with the discharge wire in the extension direction, and wherein the sheet member is disposed and held between the contact member and the support member.

6. The charger according to claim 5, wherein a hole for inserting the discharge wire is formed in the sheet member, and a slit is formed in the sheet-member which extends from the hole and reaches to the distal end, extending along the extension direction, wherein the support member comprises two arm portions each configured to be flexible and to support one of or the other one of halves of the sheet member divided by the slit, and wherein the cleaning member is configured such that when the sheet member is mounted to the support member, the slit is open due to a difference in shape of corresponding mounting portions of the arm portions and the sheet member.

7. The charger according to claim 6, wherein the cleaning member is configured such that when it is mounted to the frame, the notches of the sheet member are brought into contact with the frame, so that the slit is more widely open.

8. The charger according to claim 6, wherein tapering surfaces are formed on the frame, by which each of the arm portions is forced to move closer to each other.

9. A charger comprising:

a discharge wire extending in a predetermined extension direction;

a grid electrode extending in the extension direction along which the discharge wire extends and facing to the discharge wire;

a frame configured to support the discharge wire and the grid electrode; and a cleaning member configured to move in the extension direction while slidably contacting with the grid electrode so as to clean the grid electrode, wherein the cleaning member comprises a sheet member, and an abrasive member for scraping off an object adhering to the grid electrode, and wherein the abrasive member is folded to surround a distal end of the sheet member and in contact with the grid electrode at a folded portion thereof.

10. The charger according to claim 9, wherein the sheet member is configured to be flexible, and wherein in a flexurally deformed state, the sheet member presses the abrasive member against the grid electrode.

11. The charger according to claim 9, further comprising a pair of shield electrodes between which the discharge electrode is interposed, wherein a pair of wipe-off members for slidably contacting with the shield electrodes are provided on both side ends of the sheet member.

12. The charger according to claim 11, wherein a notch is formed in the sheet member between the distal end and each of the side ends.

13. The charger according to claim 9, wherein the abrasive member is a metal file.

14. The charger according to claim 13, wherein the cleaning member comprises:

a support member configured to support the sheet member; and an electrically insulative contact member configured to be supported by the support member and to slidably contact with the discharge wire in the extension direction, and wherein a part of the contact member extends between the metal file provided on the distal end of the sheet member and the discharge wire as viewed from the extension direction.

15. The charger according to claim 14, wherein a hole for inserting the discharge wire is formed in the sheet member, and a slit is formed in the sheet member which extends from the hole and reaches to the distal end, wherein the support member comprises two arm portions each configured to be flexible and to support one of or the other one of halves of the sheet member divided by the slit, and wherein the cleaning member is configured such that when the sheet member is mounted to the support member, the slit is open due to a difference in shape of corresponding mounting portions of the arm portions and the sheet member.

16. The charger according to claim 15, wherein the cleaning member is configured such that when it is mounted to the frame, both side ends of the sheet member are brought into contact with the frame, so that the slit is more widely open.

17. The charger according to claim 15, wherein tapering surfaces are formed on the frame, by which each of the arm portions is forced to move closer to each other.

18. The charger according to claim 13, wherein the frame is made of an electrically insulative material, and wherein when the cleaning member is in a stand-by position at an end side of the discharge wire, the metal file is positioned away from the grid electrode and in contact with the frame.

19. The charger according to claim 9, wherein the cleaning member comprises:

a support member configured to support the sheet member; and a contact member configured to be supported by the support member and to slidably contact with the discharge wire in the extension direction, and wherein the sheet member is held between the contact member and the support member.

20. A charger comprising:

a discharge wire extending in a predetermined extension direction;

an opposite electrode extending in the extension direction along which the discharge wire extends and facing to the discharge wire;

a frame configured to support the discharge wire and the opposite electrode; and a cleaning member configured to move in the extension direction while slidably contacting with the opposite electrode so as to clean the opposite electrode;

wherein the cleaning member is configured to reciprocate along the extension direction, and a moving direction of the cleaning member is switchable between a first direction and a second direction opposite to the first direction, wherein the cleaning member comprises a sheet member configured to be flexible and to contact with the opposite electrode, and wherein the sheet member has a first surface and a second surface that is opposite to the first surface, the first surface having a first roughness and the second surface having a second roughness different from the first roughness, and the sheet member is configured such that:

when the cleaning member moves in a first direction along the extension direction, the first surface contacts with the opposite electrode and the second surface faces away from the opposite electrode; and when the cleaning member moves in a second direction opposite to the first direction, the second surface contacts with the opposite electrode and the first surface faces away from the opposite electrode.

21. The charger according to claim 20, wherein the sheet member is formed by laminating a first member which constitutes one of the first and second surfaces and a second member which constitutes the other one of the second and first surfaces and is made of a different material from that of the first member.

22. The charger according to claim 21, wherein the first member is an abrasive member for scraping off an object adhering to the opposite electrode, and the second member is a wipe-off member configured to be more flexible than the first member and adapted to wipe off an object adhering to the opposite electrode.

23. The charger according to claim 22, wherein the second member is a felt member.

24. The charger according to claim 20, wherein a pair of engagement portions are provided at both end portions of the opposite electrode as viewed in the extension direction, the engagement portion being configured to engage with the sheet member for switching between the first and second surfaces.

25. The charger according to claim 20, wherein the opposite electrode comprises:

a grid electrode disposed between the discharge wire and a photoconductor, the photoconductor having a surface configured to be movable and to carry an electrostatic latent image; and a pair of shield electrodes disposed along a moving direction of the surface of the photoconductor with the discharge wire interposed therebetween, wherein the sheet member includes a first end portion at which the sheet member contacts with the grid electrode, and a pair of second end portions arranged at both sides of the first end portion in a direction transverse to the first end portion and configured to contact with the shield electrodes.

26. The charger according to claim 25, wherein a notch is formed in the sheet member between the first end portion and the second end portion.

27. The charger according to claim 26, wherein the cleaning member comprises:

a support member configured to support the sheet member; and a contact member configured to be supported by the support member and to slidably contact with the discharge wire in the extension direction, and wherein the sheet member is held between the contact member and the support member.

28. The charger according to claim 27, wherein a hole for inserting the discharge wire is formed in the sheet member, and a slit is formed in the sheet-member which extends from the hole and reaches to the first end portion, wherein the support member comprises two arm portions each configured to be flexible and to support one of or the other one of halves of the sheet member divided by the slit, and wherein the cleaning member is configured such that when the sheet member is mounted to the support member, the slit is open due to a difference in shape of corresponding mounting portions of the arm portions and the sheet member.

29. The charger according to claim 28, wherein the cleaning member is configured such that when it is mounted to the frame, the second end portions of the sheet member are brought into contact with the frame, so that the slit is more widely open.

30. The charger according to claim 28, wherein tapering surfaces are formed on the frame, by which each of the arm portions is forced to move closer to each other.

* * * * *